US010605023B2

(12) United States Patent
Chou et al.

(10) Patent No.: US 10,605,023 B2
(45) Date of Patent: Mar. 31, 2020

(54) AUTOMATIC PUSH CORER SYSTEM

(71) Applicant: NATIONAL SUN YAT-SEN UNIVERSITY, Kaohsiung (TW)

(72) Inventors: Yu-Cheng Chou, Kaohsiung (TW); Hsin-Hung Chen, Kaohsiung (TW); Chau-Chang Wang, Kaohsiung (TW); Bo-Shen Huang, Kaohsiung (TW)

(73) Assignee: NATIONAL SUN YAT-SEN UNIVERSITY, Kaohsiung (TW)

( * ) Notice: Subject to any disclaimer, the term of this patent is extended or adjusted under 35 U.S.C. 154(b) by 189 days.

(21) Appl. No.: 15/983,648

(22) Filed: May 18, 2018

(65) Prior Publication Data

US 2019/0338611 A1 Nov. 7, 2019

(30) Foreign Application Priority Data

May 2, 2018 (TW) ..... 107114891 A

(51) Int. Cl.
*E21B 25/18* (2006.01)
*E21B 3/02* (2006.01)

(52) U.S. Cl.
CPC ..... *E21B 25/18* (2013.01); *E21B 3/02* (2013.01)

(58) Field of Classification Search
CPC ..... E21B 25/18; E21B 3/02
(Continued)

(56) References Cited

U.S. PATENT DOCUMENTS 6,234,047 B1 * 5/2001 Yamada ..... F16H 27/08 74/436
6,394,192 B1 * 5/2002 Frazer ..... E21B 7/124 175/58

(Continued)

FOREIGN PATENT DOCUMENTS

CN 104316349 A 1/2015
CN 105865834 A 8/2016

(Continued)

OTHER PUBLICATIONS

Notice of Allowance dated Apr. 15, 2019 issued by Taiwan Intellectual Property Office for counterpart application No. 107114891.

(Continued)

*Primary Examiner* — Anna M Momper
*Assistant Examiner* — Patrick F Lambe
(74) *Attorney, Agent, or Firm* — WPAT, P.C., Intellectual Property Attorneys

(57) ABSTRACT

The present disclosure provides an automatic push corer system including a base, a power group, a Geneva transmission group, an intermittent transmission group, a vertical coring transmission group, a clamp group and a coring group. The power group is used to drive the Geneva transmission group. The Geneva transmission group is configured to perform a first intermittent rotary motion. The intermittent transmission group is configured to perform a second intermittent rotary motion. The vertical coring transmission group is configured to cooperate with the second intermittent rotary motion to perform a third intermittent rotary motion. The clamp group is configured to cooperate with the third intermittent rotary motion to perform a lifting reciprocation. The coring group is configured to cooperate with the first intermittent rotary motion and the lifting reciprocation to respectively complete a coring operation and a tubing replacing operation. Therefore, the automatic (Continued)

push corer system may use a single power source to complete positioning and coring operations on the marine sediment.

14 Claims, 15 Drawing Sheets

(58) Field of Classification Search
USPC ..... 175/6
See application file for complete search history.

(56) References Cited

U.S. PATENT DOCUMENTS

| | | | | |
|---|---|---|---|---|
| 8,925,650 | B2 * | 1/2015 | Choi | G01N 1/08 175/245 |
| 9,322,220 | B2 * | 4/2016 | Innes | E21B 25/18 |
| 2009/0178848 | A1 * | 7/2009 | Nellessen, Jr. | E21B 7/12 175/7 |

FOREIGN PATENT DOCUMENTS

| | | | |
|---|---|---|---|
| TW | 201350184 | A | 12/2013 |
| WO | WO9906741 | A1 | 2/1999 |

OTHER PUBLICATIONS

Huang, Bo-Shen, Design of an Automatic Push Corer, Institute of Undersea Technology National Sun Yat-sen University Master Thesis, Jan. 2018.

Huang, Bo-Shen et al., Design of an Automatic Push Corer, May 19, 2017.

Office Action and Search Report dated Oct. 24, 2018 issued by Taiwan Intellectual Property Office for counterpart application 107114891.

English Abstract Translation of Search Report issued by Taiwan Intellectual Property Office for counterpart application 107114891.

English Abstract Translation of Foreign Patent Document CN104316349A.

English Abstract Translation of Foreign Patent Document CN105865834A.

English Abstract Translation of Foreign Patent Document TW201350184A.

U.S. Pat. No. 6,234,047 is the Translation of Foreign Patent Document WO9906741A1.

* cited by examiner

AUTOMATIC PUSH CORER SYSTEM

BACKGROUND OF THE DISCLOSURE

1. Field of the disclosure

The disclosure relates to an automatic push corer system.

2. Description of the Related Art

Coring and analyzing seabed sediment has significance for research fields such as marine organisms, marine geology, and marine chemistry. Currently common corers may approximately include a clamping jaw corer, a gravity corer, and a push corer. The clamping jaw corer and the gravity corer may both be lowered to the seabed by means of weights of the clamping jaw corer and the gravity corer and by using a winch of a working mother ship, for coring. After coring is completed, the clamping jaw corer and the gravity corer are pulled up and retracted by using the winch of the working mother ship again. However, by using the clamping jaw corer and the gravity corer, a coring site cannot be accurately selected, and dense coring cannot be performed.

The push corer may move and select a coring site by using a remotely operated vehicle (ROV) for an underwater image by a driver on the working mother ship, and operates a mechanical arm to clamp a coring tube to core sediment after selecting the coring site. Therefore, compared with the clamping jaw corer and the gravity corer, the push corer can accurately select a coring site, and can perform dense coring. However, the push corer needs to be used by a skilled driver by operating the ROV and the mechanical arm; otherwise operating efficiency is easy to be affected. In addition, in an operating environment of a not good enough sea condition, even if the skilled driver wants to operate the ROV and the mechanical arm to complete a coring action, this is a quite difficult task. In addition, for a small and medium-sized ROV, a mechanical arm of a high degree of freedom is usually difficult to be equipped, so that the push corer cannot be used to perform sediment coring.

SUMMARY OF THE DISCLOSURE

The present disclosure provides an automatic push corer system. In an embodiment, the automatic push corer system includes a base, a power group, a Geneva transmission group, an intermittent transmission group, a vertical coring transmission group, a clamp group and a coring group. The power group is disposed on the base. The power group has a rotating shaft and a motor. The rotating shaft is coupled to the motor. The Geneva transmission group is disposed on the base, and the Geneva transmission group has a driving member and a driven member. The driving member is coupled to the rotating shaft of the power group, and the driven member is coupled to the driving member. The driving member is configured to control the driven member to perform a first intermittent rotary motion. The intermittent transmission group is disposed on the base. The intermittent transmission group has a first transmission member and a second transmission member. The first transmission member is coupled to the rotating shaft of the power group, and the second transmission member is coupled to the first transmission member. The first transmission member is configured to cooperate with the second transmission member to perform a second intermittent rotary motion. The vertical coring transmission group is disposed on the base. The vertical coring transmission group has a third transmission member, a fourth transmission member, and a fifth transmission member. The third transmission member is coupled to the second transmission member of the intermittent transmission group, and the third transmission member is coupled to the fourth transmission member and the fifth transmission member. The third transmission member is configured to cooperate with the second intermittent rotary motion of the intermittent transmission group to control the fourth transmission member and the fifth transmission member to perform a third intermittent rotary motion. The clamp group is coupled to the fourth transmission member and the fifth transmission member of the vertical coring transmission group. The clamp group is configured to cooperate with the third intermittent rotary motion of the vertical coring transmission group to perform a lifting reciprocation. The coring group is coupled to the driven member of the Geneva transmission group. The coring group has a plurality of coring tubes. The coring group is configured to cooperate with the first intermittent rotary motion of the driven member, and cooperate with the lifting reciprocation of the clamp group, to respectively complete a coring operation and a tubing replacing operation.

Therefore, the automatic push corer system of the present invention may use a single power source of the motor of the power group, and cooperate with the Geneva transmission group, the intermittent transmission group, the vertical coring transmission group, the clamp group, and the coring group, to complete tube replacing operations and several times of coring operations of the coring tubes so as to achieve effects of simplifying the structure of the automatic push corer system. In addition, by using the automatic push corer system of the present invention, positioning and coring operations on the marine sediment can further be completed with a small and medium-sized ROV to improve usage convenience.

DETAILED DESCRIPTION OF THE DISCLOSURE

Figure 1:
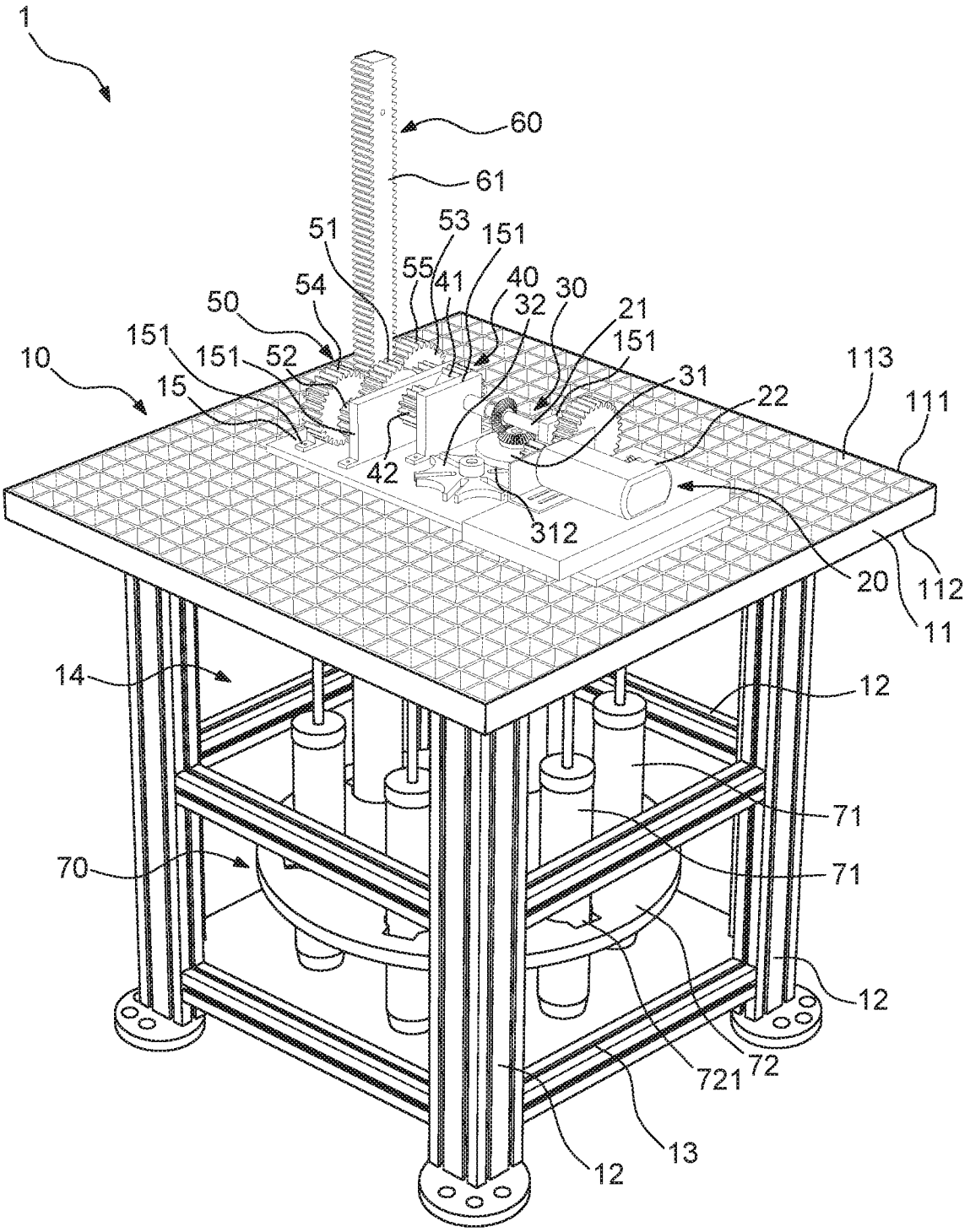
FIG. 1 is a schematic perspective diagram of an automatic push corer system according to the present invention.

"Coupled" in the full text of the present invention may be defined as "directly coupled" or "indirectly coupled". "Directly coupled" means that two elements are connected to each other, and "indirectly coupled" means that two elements may provide, by using another element, a function of connecting elements without affecting the precondition of the original transmission manner FIG. 1 is a schematic perspective diagram of an automatic push corer system according to the present invention. Referring to FIG. 1, in an embodiment, an automatic push corer system 1 of the present invention includes a base 10, a power group 20, a Geneva transmission group 30, an intermittent transmission group 40, a vertical coring transmission group 50, a clamp group 60, and a coring group 70. The automatic push corer system 1 is mainly configured to perform a coring operation on marine sediment, but is not limited to the foregoing.

Figure 2:
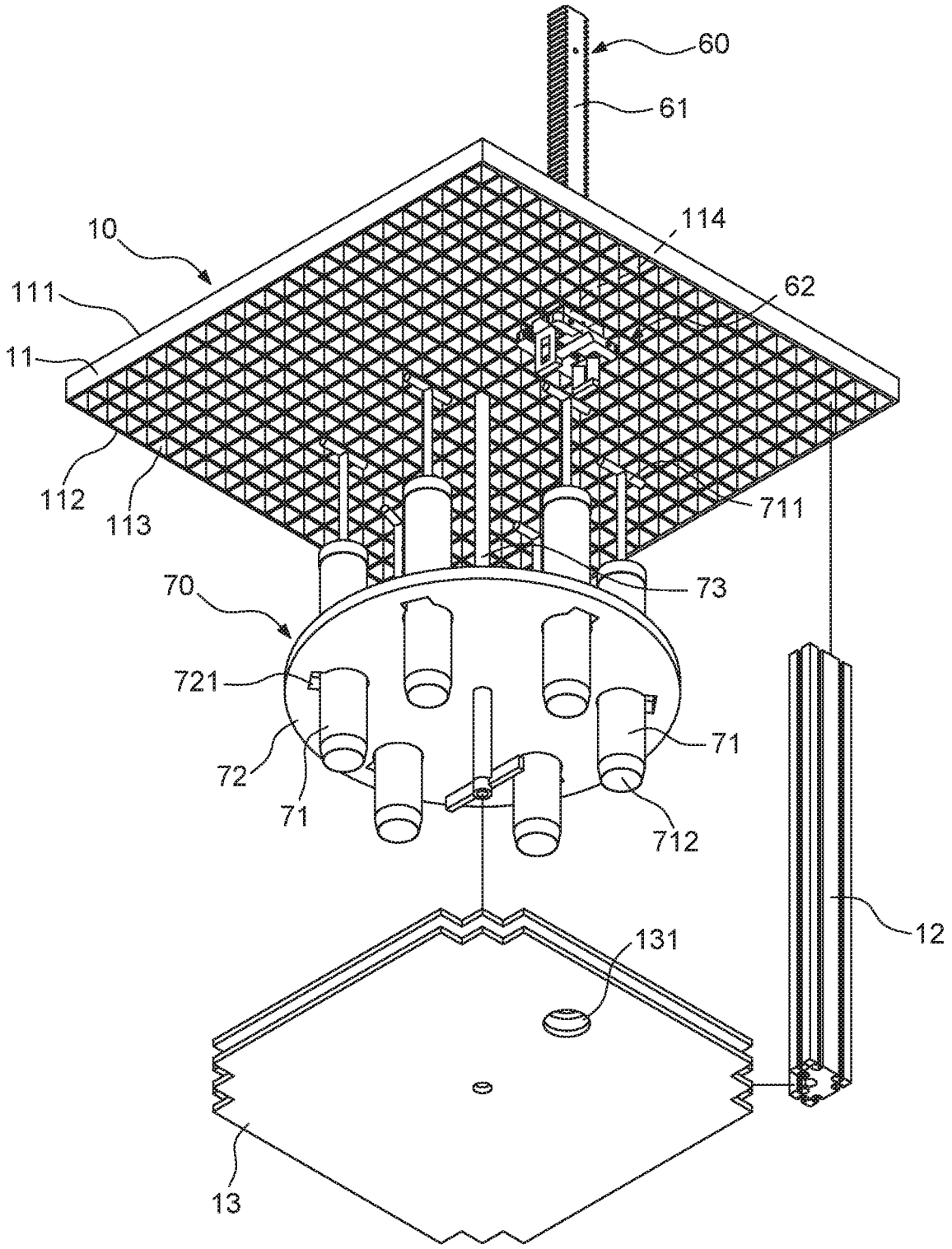
FIG. 2 is a bottom perspective exploded view of a base, a clamp group and a coring group of an automatic push corer system according to the present invention.

FIG. 2 is a bottom perspective exploded view of a base, a clamp group and a coring group of an automatic push corer system according to the present invention. Referring to FIG. 1 and FIG. 2, in an embodiment, the base 10 includes a base body 11, several positioning frames 12, and a baseplate 13. The base body 11 has a first surface 111 and a second surface 112 that are opposite to each other, and the base body 11 is provided with several penetration holes 113 and a through hole 114 that run through the first surface 111 and the second surface 112. The penetration holes 113 may be configured to effectively reduce water resistance when the automatic push corer system 1 of the present invention is disposed under water, and the through hole 114 may be provided for the clamp group 60 to successfully perform lifting movement. The positioning frames 12 are connected to each other to form a frame body, and the frame body is combined with the second surface 112 of the base body 11, so that the automatic push corer system 1 of the present invention can be more firmly disposed on the seabed. The baseplate 13 is connected to the positioning frames 12, and the baseplate 13 is provided with a punch 131, may be provided for a related component of the coring group 70 to pass, and is configured to perform the coring operation on the marine sediment.

The base body 11, the positioning frames 12, and the baseplate 13 together enclose an accommodating space 14, a fixing manner between the base body 11, the positioning frames 12, and the baseplate 13 may be, for example, fastening, clamping, or welding, and the accommodating space 14 is configured to accommodate the clamp group 60 and the coring group 70.

A fixing base 15 may be disposed on the first surface 111 of the base 10, the fixing base 15 may have several pivoting plates 151, there is respectively a gap between the pivoting plates 151 to dispose related components such as the power group 20, the Geneva transmission group 30, the intermittent transmission group 40 and the vertical coring transmission group 50.

Figure 3:
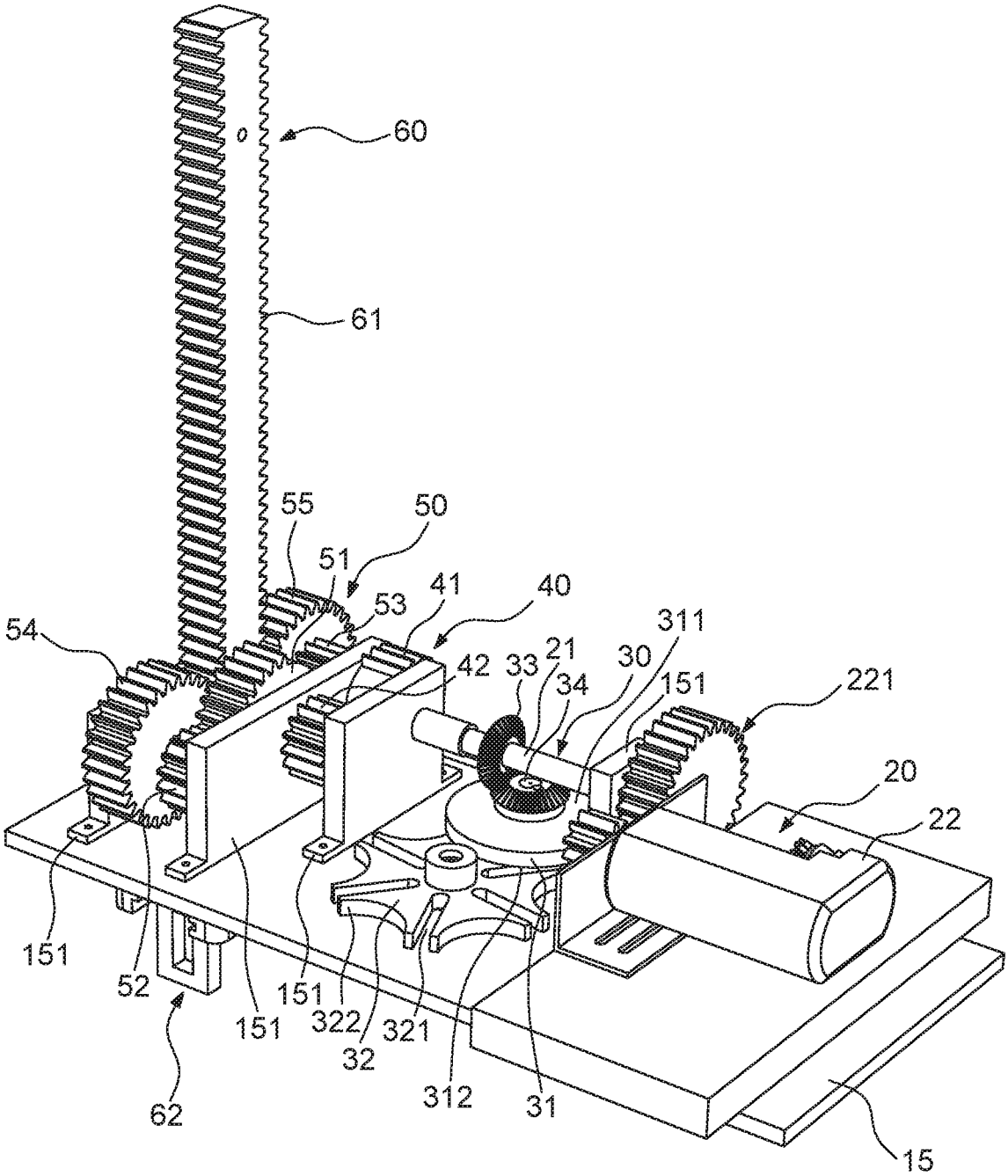
FIG. 3 is a schematic perspective diagram of a power group, a Geneva transmission group, an intermittent transmission group, a vertical coring transmission group and a clamp group of an automatic push corer system according to the present invention.

FIG. 3 is a schematic perspective diagram of a power group, a Geneva transmission group, an intermittent transmission group, a vertical coring transmission group and a clamp group of an automatic push corer system according to the present invention. Referring to FIG. 1 to FIG. 3, in an embodiment, the power group 20 is disposed on the base 10, the power group 20 includes a rotating shaft 21 and a motor 22, and the motor 22 is coupled to the rotating shaft 21 to drive the rotating shaft 21 to rotate. The rotating shaft 21 is rotatablely disposed on the pivoting plates 151 of the fixing base 15. The motor 22 may be fixed to the fixing base 15, so that the power group 20 may be firmly combined with the base 10. The motor 22 may be selected to be directly connected to the rotating shaft 21; or, as shown in FIG. 3, the motor 22 may indirectly use a deceleration gear group 221 to be connected to the rotating shaft 21, to ensure that the motor 22 can steadily provide rotary power, and a submerged motor may be selected for the motor 22. In an embodiment, power required by the motor 22 may be provided by a battery (not shown) or a cable (not shown) for the motor 22, and the motor 22 may be controlled to operate by using a controller (not shown).

Figure 4:
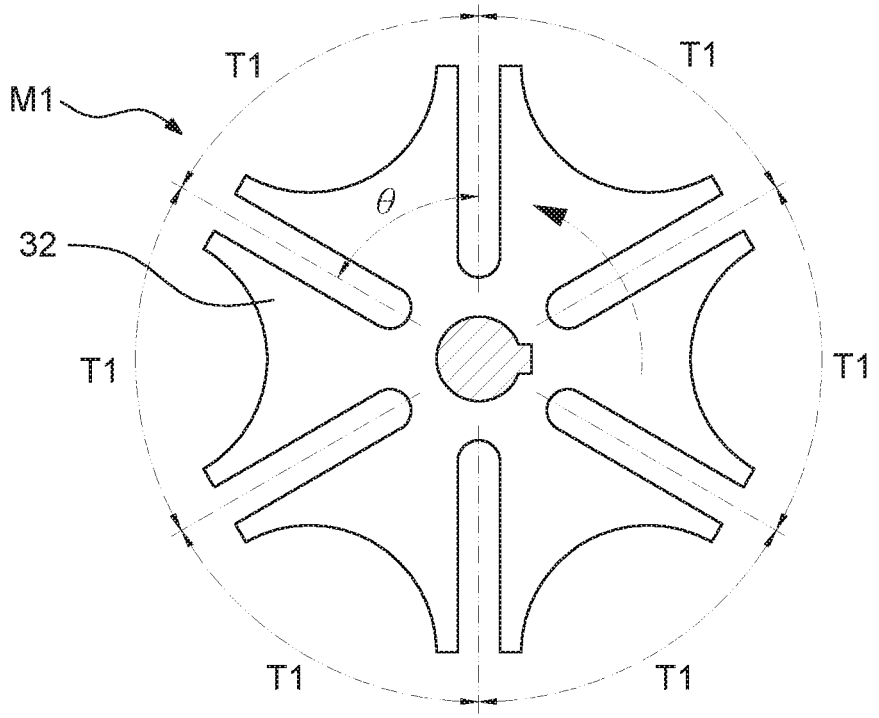
FIG. 4 is a schematic diagram showing that a Geneva transmission group of an automatic push corer system performs first intermittent rotary motion according to the present invention.

Referring to FIG. 1 to FIG. 3, in an embodiment, the Geneva transmission group 30 is disposed on the base 10, the Geneva transmission group 30 includes a driving member 31 and a driven member 32, the driving member 31 is coupled to the rotating shaft 21 of the power group 20, and the driven member 32 is coupled to the driving member 31. The Geneva transmission group 30 (namely, a Geneva Mechanism) of the present invention is a Geneva mechanism formed by selecting, under a precondition of having an index function, a structure that can perform intermittent rotary motion. Therefore, a pattern and a type of the Geneva transmission group 30 are not limited. For example, FIG. 4 is a schematic diagram showing that a Geneva transmission group of an automatic push corer system performs first intermittent rotary motion according to the present invention. Referring to FIG. 3 and FIG. 4, the Geneva transmission group 30 of the present invention performs rotary motion at a fixed speed by using the driving member 31, the driving member 31 may be configured to control the driven member 32 to perform first intermittent rotary motion M1, and the first intermittent rotary motion M1 includes several index stages T1.

Referring to FIG. 1 to FIG. 3 again, in an embodiment, the driving member 31 of the Geneva transmission group 30 has a first end surface 311 and a second end surface 312 that are opposite to each other, and the second end surface 312 faces the first surface 111 of the base 10. The driving member 31 and the driven member 32 of the Geneva transmission group 30 are rotatablely combined with the fixing base 15 of the base body 11, so that the driving member 31 and the driven member 32 can steadily rotate on the fixing base 15. An element such as a connecting shaft or a bearing may be selected for the driving member 31 and the driven member 32 to be combined with the fixing base 15, but this is not limited to the foregoing.

In an embodiment, the driving member 31 may be selected to use a first bevel gear 33 and a second bevel gear 34 to be connected to the rotating shaft 21. The first bevel gear 33 is disposed on the rotating shaft 21 and configured to cooperate with the rotating shaft 21 to rotate; and the second bevel gear 34 is disposed on the first end surface 311 of the driving member 31 and configured to cooperate with the driving member 31 to rotate. The first bevel gear 33 and the second bevel gear 34 engage with each other, so that the rotating shaft 21 can control the driving member 31 to rotate. The first bevel gear 33 and the second bevel gear 34 are designed to convert rotation in a vertical direction that is provided by the rotating shaft 21 to rotation in a horizontal direction of the driving member 31, to achieve a power steering function.

Figure 5:
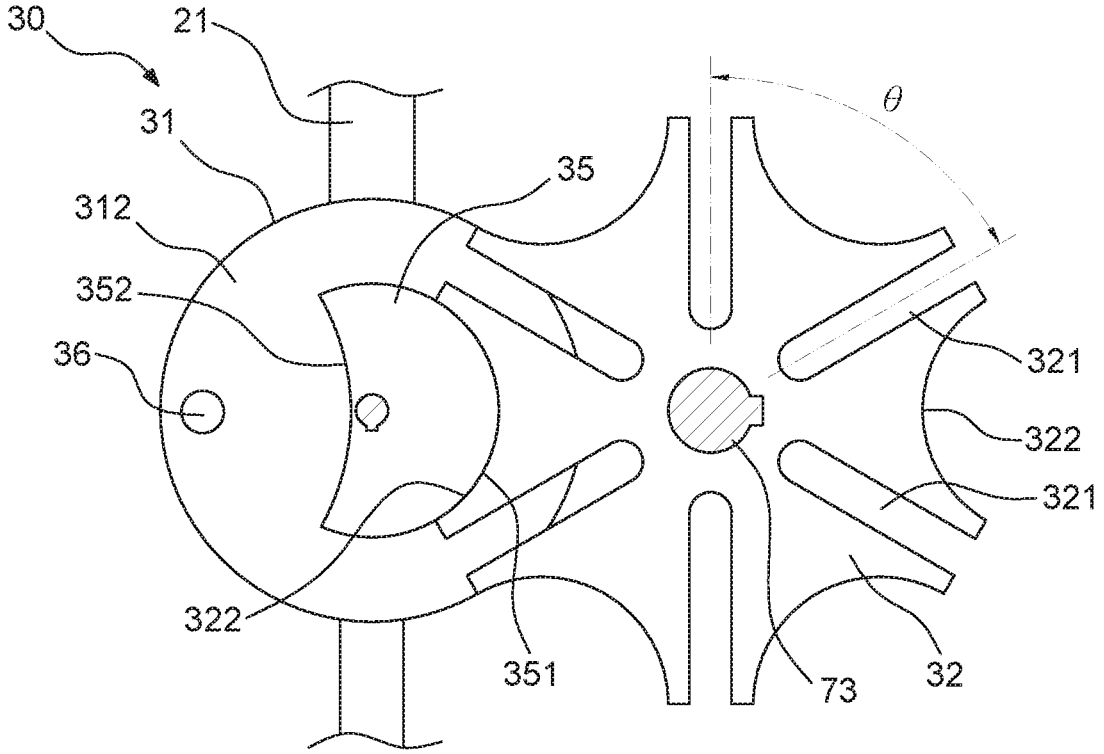
FIG. 5 is a schematic bottom view of a Geneva transmission group of an automatic push corer system in a first state according to the present invention.

FIG. 5 is a schematic bottom view of a Geneva transmission group of an automatic push corer system in a first state according to the present invention. Referring to FIG. 3 to FIG. 5, in an embodiment, the first intermittent rotary motion M1 performed by the Geneva transmission group 30 includes six index stages T1, but is not limited to the foregoing. In this embodiment, a locking plate 35 and a pin member 36 are disposed on the second end surface 312 of the driving member 31. A periphery of the locking plate 35 is provided with a convex arc portion 351 and a concave portion 352, and the pin member 36 is opposite to the concave portion 352 of the locking plate 35. A periphery of the driven member 32 is provided with several radial grooves 321 and several concave arc portions 322, and the concave arc portions 322 may be in cooperation with the convex arc portion 351 of the locking plate 35. Because the Geneva mechanism in this embodiment includes six index stages T1, the radial grooves 321 each have a groove centerline extending radially outward from a center point of the driven member 32, there is respectively a rotation angle θ between the groove centerlines of the radial grooves 321, and the rotation angle is 60°. In this way, there is one concave arc portion 322 between any two of the radial grooves 321, that is, numbers of the radial grooves 321 and the concave arc portions 322 are respectively six, to correspond to the six index stages T1 included in the first intermittent rotary motion M1.

Further, actuation manners of each index stage T1 of the Geneva transmission group 30 may approximately be distinguished as four states. The embodiment disclosed in FIG. 5 is a first state. The first state discloses that the pin member 36 has not entered the radial grooves 321 of the driven member 32. In this case, the concave arc portions 322 of the driven member 32 cooperates with the convex arc portion 351 of the locking plate 35. Therefore, the driven member 32 is in a static state.

Figure 6:
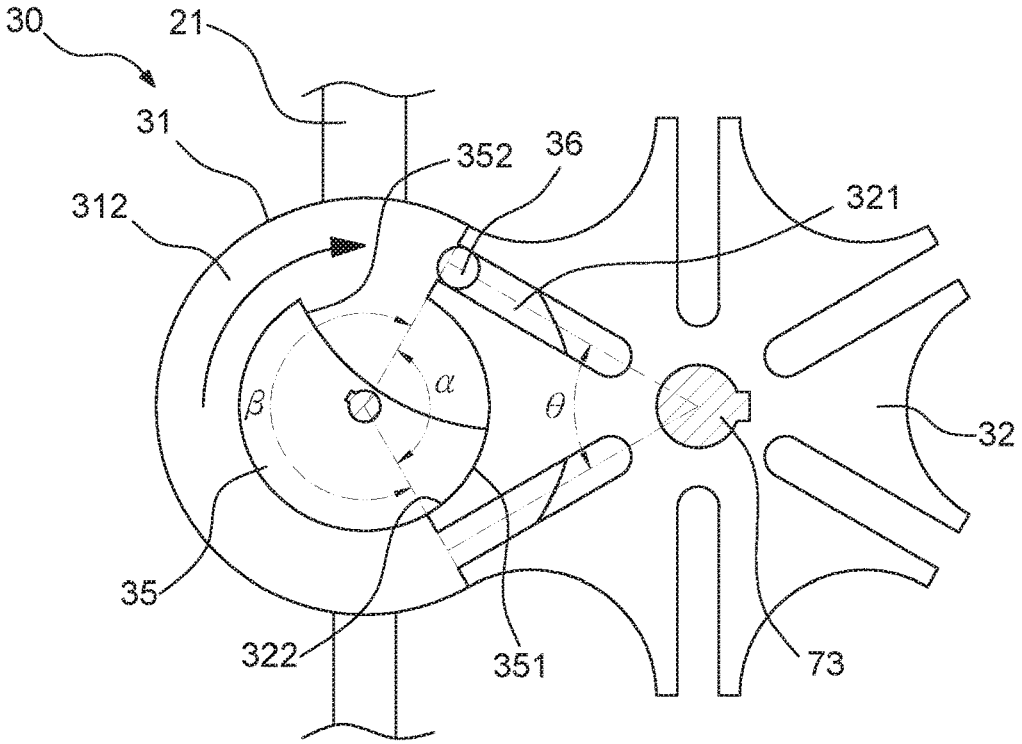
FIG. 6 is a schematic bottom view of a Geneva transmission group of an automatic push corer system in a second state according to the present invention.

FIG. 6 is a schematic bottom view of a Geneva transmission group of an automatic push corer system in a second state according to the present invention. Referring to FIG. 6, the second state discloses that when the rotating shaft 21 drives the driving member 31 to rotate, the locking plate 35 and the pin member 36 may also cooperate to rotate. Because the locking plate 35 has the concave portion 352, the locking plate 35 does not limit rotation of the driven member 32, and the pin member 36 can successfully enter the radial grooves 321 of the driven member 32, to facilitate subsequently pushing the driven member 32 to start to rotate.

Figure 7:
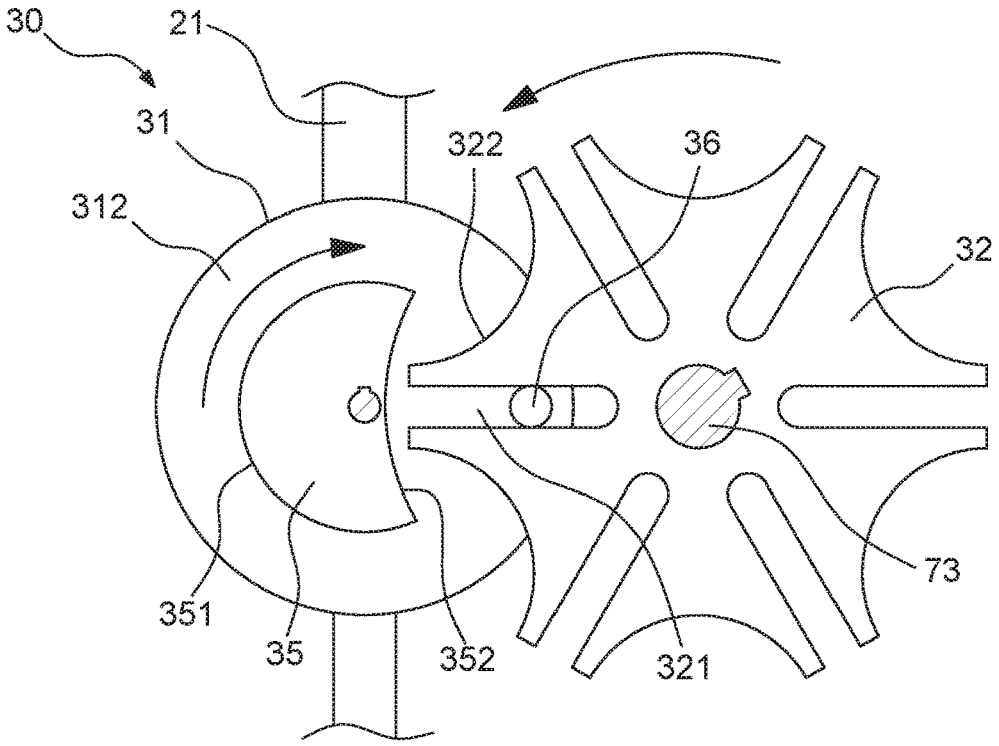
FIG. 7 is a schematic bottom view of a Geneva transmission group of an automatic push corer system in a third state according to the present invention.

FIG. 7 is a schematic bottom view of a Geneva transmission group of an automatic push corer system in a third state according to the present invention. Referring to FIG. 7, the third state discloses that during rotation of the driving member 31, the locking plate 35 and the pin member 36, the pin member 36 may slide in the radial grooves 321 of the driven member 32, and continuously push the driven member 32 to continue to rotate.

Figure 8:
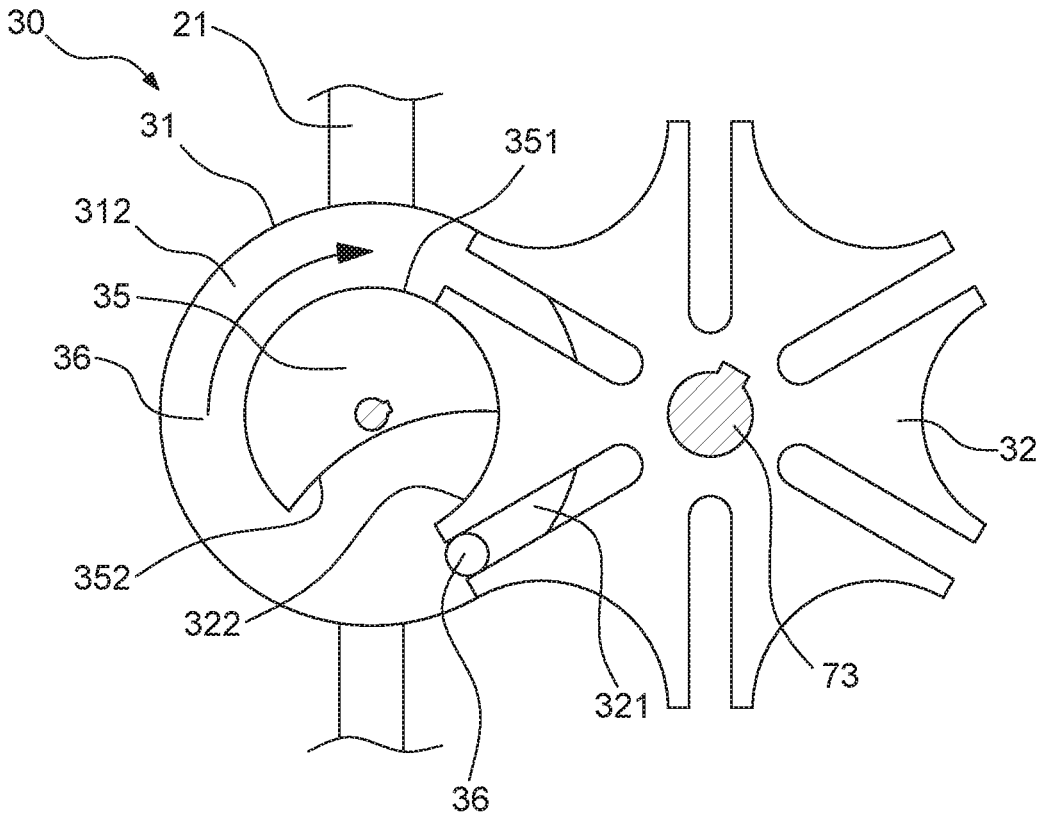
FIG. 8 is a schematic bottom view of a Geneva transmission group of an automatic push corer system in a fourth state according to the present invention.

FIG. 8 is a schematic bottom view of a Geneva transmission group of an automatic push corer system in a fourth state according to the present invention. Referring to FIG. 8, the fourth state discloses that after the pin member 36 leaves the radial grooves 321 of the driven member 32, the concave arc portions 322 of the driven member 32 cooperates with the convex arc portion 351 of the locking plate 35 again, so that the driven member 32 is in a static state.

Referring to FIG. 4 to FIG. 6 again, when the rotating shaft 21 of the power group 20 controls the driving member 31 to rotate one cycle, the driven member 32 may complete an index stage T1. An example in which the first intermittent rotary motion M1 includes six index stages T1 is used. When the driving member 31 rotates one cycle, the rotation angle θ of the driven member 32 is 60°. A rotation time for a rotation angle $\alpha=120°$ when the driving member 31 rotates one cycle is used to set to a rotation time of the driven member 32; and a rotation time for another rotation angle $\beta=240°$ when the driving member 31 rotates one cycle is used to set to a static time of the driven member 32. In this way, the driven member 32 is in the static time, the coring group 70 may complete a coring operation on marine sediment; and when the driven member 32 is in the rotation time, the coring group 70 may complete a tubing replacing operation (for details, reference is made to descriptions of the coring group 70).

Referring to FIG. 1 and FIG. 3 again, in an embodiment, the intermittent transmission group 40 is disposed on the base 10, the intermittent transmission group 40 includes a first transmission member 41 and a second transmission member 42, the first transmission member 41 is coupled to the rotating shaft 21 of the power group 20, and the second transmission member 42 is coupled to the first transmission member 41. The first transmission member 41 and the second transmission member 42 are rotatablely combined with the pivoting plates 151 of the base body 11, so that the first transmission member 41 and the second transmission member 42 can steadily rotate between the pivoting plates 151. An element such as a connecting shaft or a bearing may be selected for the first transmission member 41 and the second transmission member 42 to be combined with the pivoting plates 151, but this is not limited to the foregoing.

Figure 9:
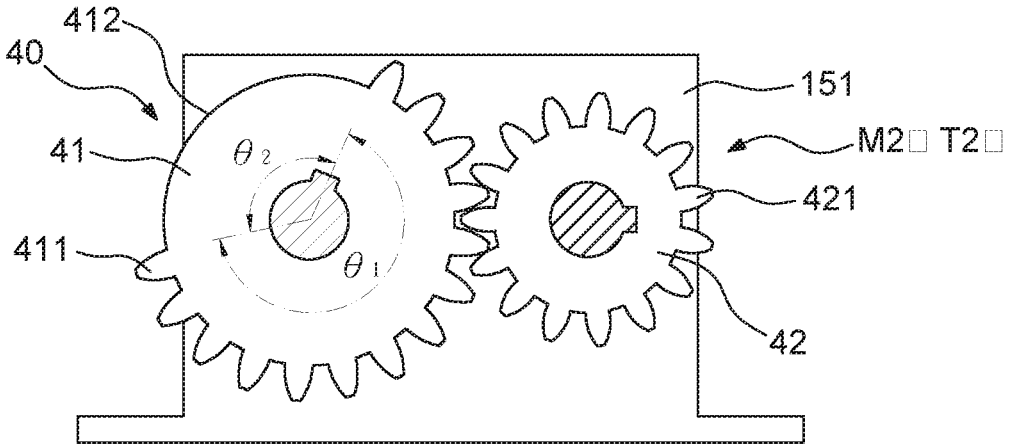
FIG. 9 is a schematic front view of an intermittent transmission group of an automatic push corer system in an actuation stage according to the present invention.
Figure 10:
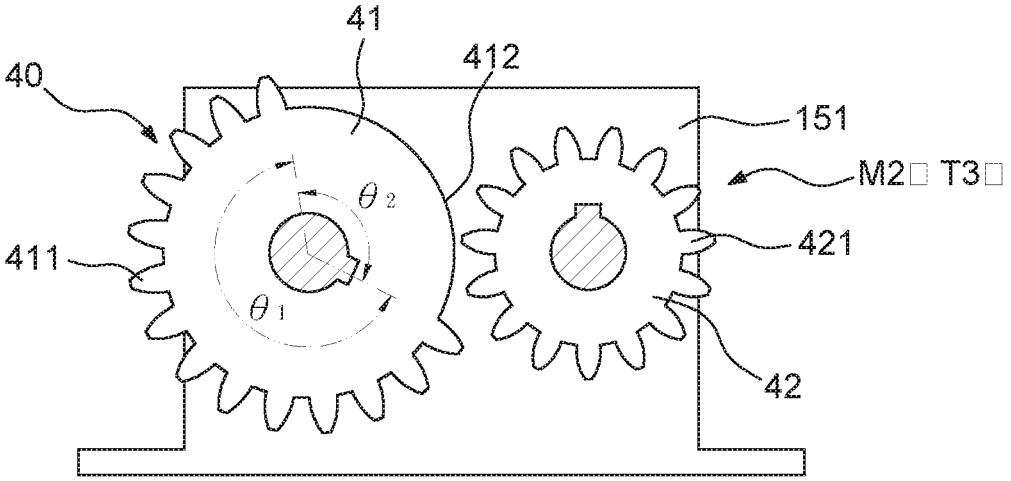
FIG. 10 is a schematic front view of an intermittent transmission group of an automatic push corer system in a standstill stage according to the present invention.

FIG. 9 is a schematic front view of an intermittent transmission group of an automatic push corer system in an actuation stage according to the present invention. FIG. 10 is a schematic front view of an intermittent transmission group of an automatic push corer system in a standstill stage according to the present invention. Referring to FIG. 3, FIG. 9 and FIG. 10, in an embodiment, a periphery of the first transmission member 41 is provided with a first grinding tooth portion 411 and a first inserted tooth portion 412. A periphery of the second transmission member 42 is provided with a second grinding tooth portion 421. The first transmission member 41 is connected to the rotating shaft 21, so that rotating shaft 21 can drive the first transmission member 41 to rotate, and the second transmission member 42 and the first transmission member 41 are connected to each other. In this way, as shown in FIG. 9, during rotation of the first transmission member 41, the first grinding tooth portion 411 and the second grinding tooth portion 421 of the second transmission member 42 are opposite to each other, so that when the first grinding tooth portion 411 engages with the second grinding tooth portion 421, the first transmission member 41 can drive the second transmission member 42 to rotate, that is, the first transmission member 41 is configured to cooperate with the second transmission member 42 to perform an actuation stage T2 of a second intermittent rotary motion M2. As shown in FIG. 10, when the first inserted tooth portion 412 and the second grinding tooth portion 421 of the second transmission member 42 are opposite to each other, and the second grinding tooth portion 421 of the second transmission member 42 does not grind the first grinding tooth portion 411, the second transmission member 42 is static, that is, the first transmission member 41 is configured to cooperate the second transmission member 42 to perform a standstill stage T3 of the second intermittent rotary motion M2.

Referring to FIG. 3, FIG. 9, and FIG. 10, in an embodiment, the first transmission member 41 is a gear, the gear of the first transmission member 41 may be based on an incomplete gear designed by "modulus=3" and "number of teeth=21", a complete number of the teeth of the gear is 14, the gear serves as the first grinding tooth portion 411, and the number of teeth corresponding to a periphery of the first inserted tooth portion 412 is seven (actually not having teeth), that is, a ratio of corresponding numbers of teeth of the first grinding tooth portion 411 and the first inserted tooth portion 412 is "14:7=2:1". The second transmission member 42 is also a gear, and the gear of the second transmission member 42 may be based on a complete gear designed by "modulus=3" and "number of teeth=15". In this way, when the motor 22 drives, by using the rotating shaft 21, the first transmission member 41 to rotate one cycle, "a rotation angle $\eta 1=240°$" is the actuation stage T2 (that is, the second transmission member 42 cooperates to rotate one cycle); and "another rotation angle $\theta 2=120°$" is the standstill stage T3 (that is, the second transmission member 42 is static). Selection of gear sizes of the first transmission member 41 and the second transmission member 42 is not limited to the foregoing, and a gear of another size may still be selected based on an actual operating requirement.

Referring to FIG. 1 to FIG. 3 again, in an embodiment, the vertical coring transmission group 50 is disposed on the base 10, the vertical coring transmission group 50 includes a third transmission member 51, a fourth transmission member 52, and a fifth transmission member 53, the third transmission member 51 is coupled to the second transmission member 42 of the intermittent transmission group 40, and the third transmission member 51 is coupled to the fourth transmission member 52 and the fifth transmission member 53. The third transmission member 51, the fourth transmission member 52 and the fifth transmission member 53 are rotatablely combined with the pivoting plates 151 of the base body 11, so that the third transmission member 51, the fourth transmission member 52, and the fifth transmission member 53 can steadily rotate between the pivoting plates 151. An element such as a connecting shaft or a bearing may be selected for the third transmission member 51, the fourth transmission member 52, and the fifth transmission member 53 to be combined with the pivoting plates 151, but this is not limited to the foregoing. In an embodiment, the third transmission member 51 is configured to cooperate with the second intermittent rotary motion M2 of the intermittent transmission group 40 to control the fourth transmission member 52 and the fifth transmission member 53 to perform a third intermittent rotary motion M3.

Figure 11:
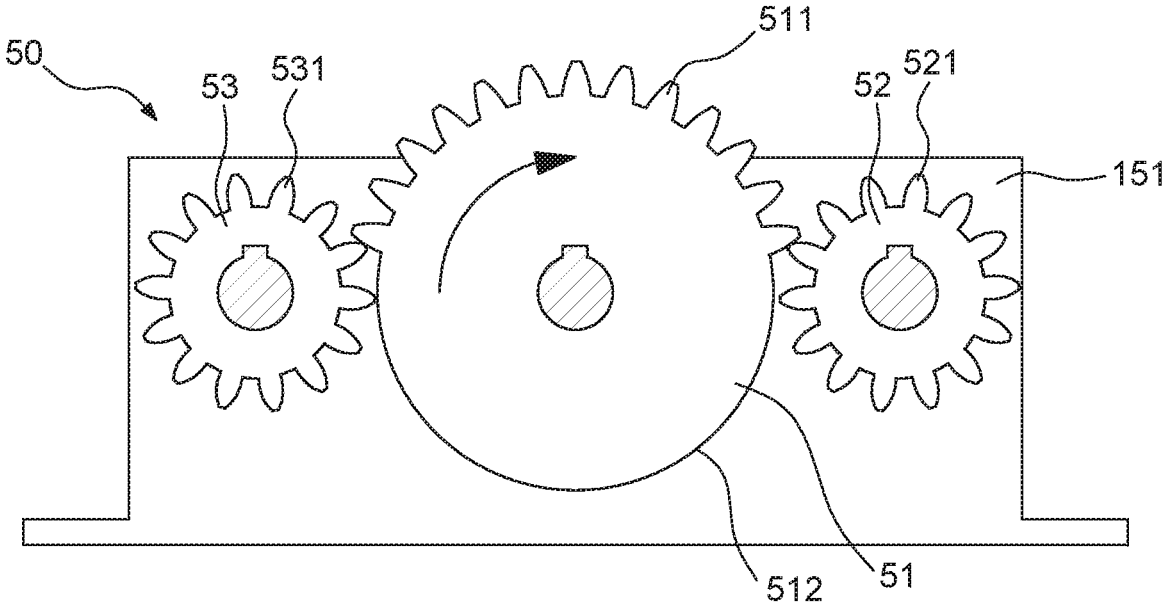
FIG. 11 is a schematic front view of a vertical coring transmission group of an automatic push corer system in a first state according to the present invention.

FIG. 11 is a schematic front view of a vertical coring transmission group of an automatic push corer system in a first state according to the present invention. Referring to FIG. 3 and FIG. 11, in an embodiment, a periphery of the third transmission member 51 is provided with a third grinding tooth portion 511 and a second inserted tooth portion 512, a periphery of the fourth transmission member 52 is provided with a fourth grinding tooth portion 521, and a periphery of the fifth transmission member 53 is provided with a fifth grinding tooth portion 531. The third transmission member 51 is connected to the second transmission member 42 of the intermittent transmission group 40, so that during rotation of the second transmission member 42, the third transmission member 51 may be driven to rotate, the fourth transmission member 52, the fifth transmission member 53 and the third transmission member 51 are connected to each other, and the third transmission member 51 is located between the fourth transmission member 52 and the fifth transmission member 53.

Figure 12:
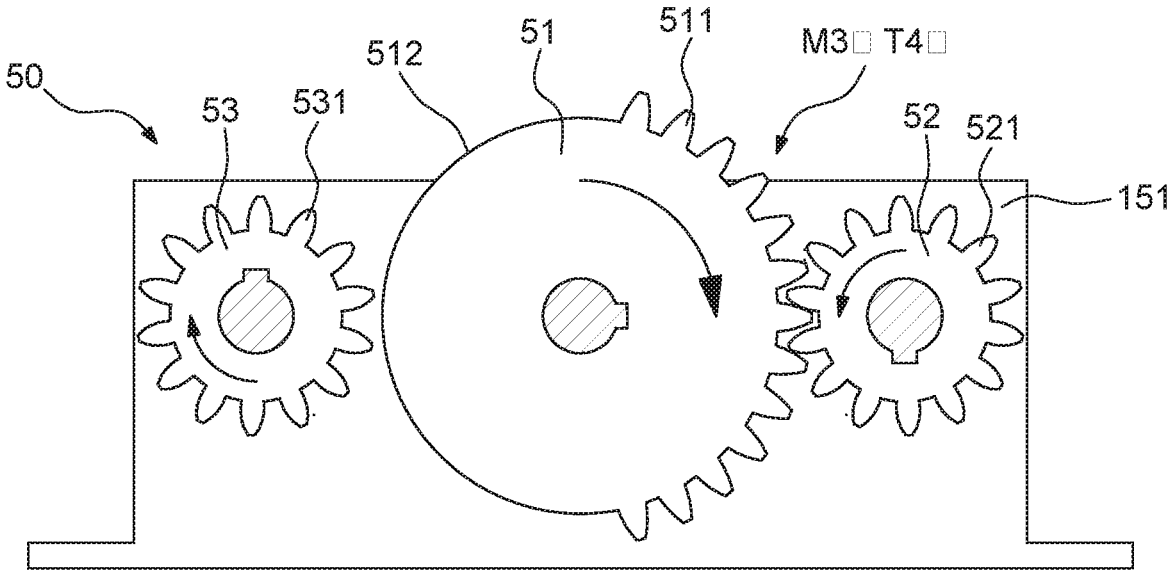
FIG. 12 is a schematic front view of a vertical coring transmission group of an automatic push corer system in a second state according to the present invention.

FIG. 12 is a schematic front view of a vertical coring transmission group of an automatic push corer system in a second state according to the present invention. Referring to FIG. 3 and FIG. 12, in an embodiment, during rotation of the third transmission member 51, when the third grinding tooth portion 511 and the fourth grinding tooth portion 521 of the fourth transmission member 52 are opposite to each other, so that when the fourth grinding tooth portion 521 engages with the third grinding tooth portion 511, the third transmission member 51 may drive the fourth transmission member 52 to rotate. In this case, the second inserted tooth portion 512 of the third transmission member 51 and the fifth grinding tooth portion 531 of the fifth transmission member 53 are opposite to each other, and the third transmission member 51 does not limit actuation of the fifth transmission member 53. In this way, the third transmission member 51 may be configured to cooperate the fourth transmission member 52 to perform a first rotary stage T4 of a third intermittent rotary motion M3.

Figure 13:
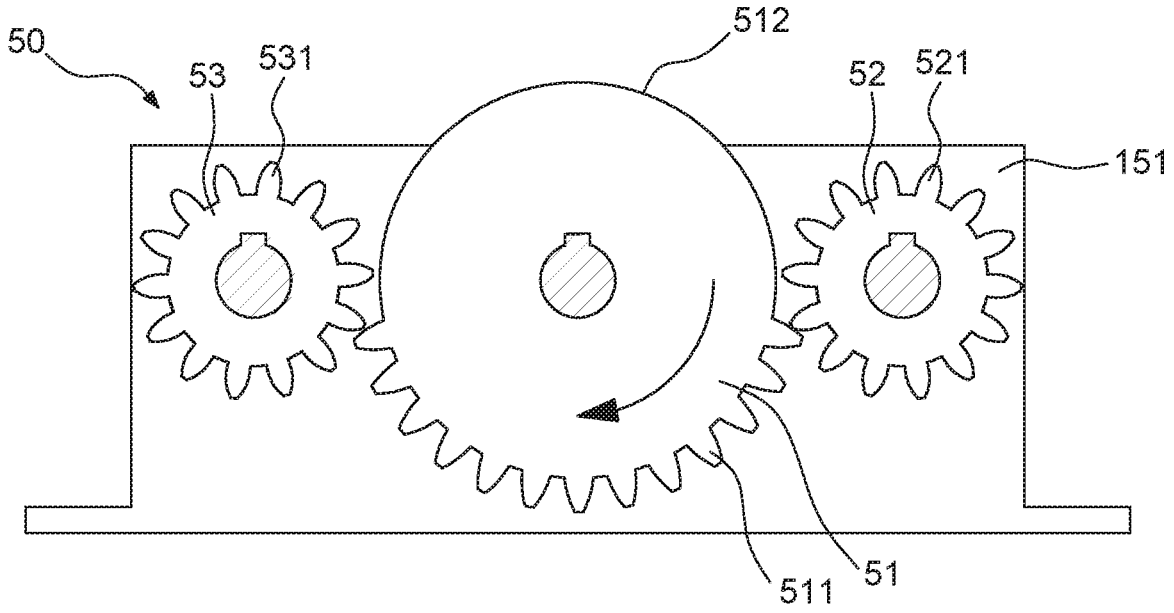
FIG. 13 is a schematic front view of a vertical coring transmission group of an automatic push corer system in a third state according to the present invention.
Figure 14:
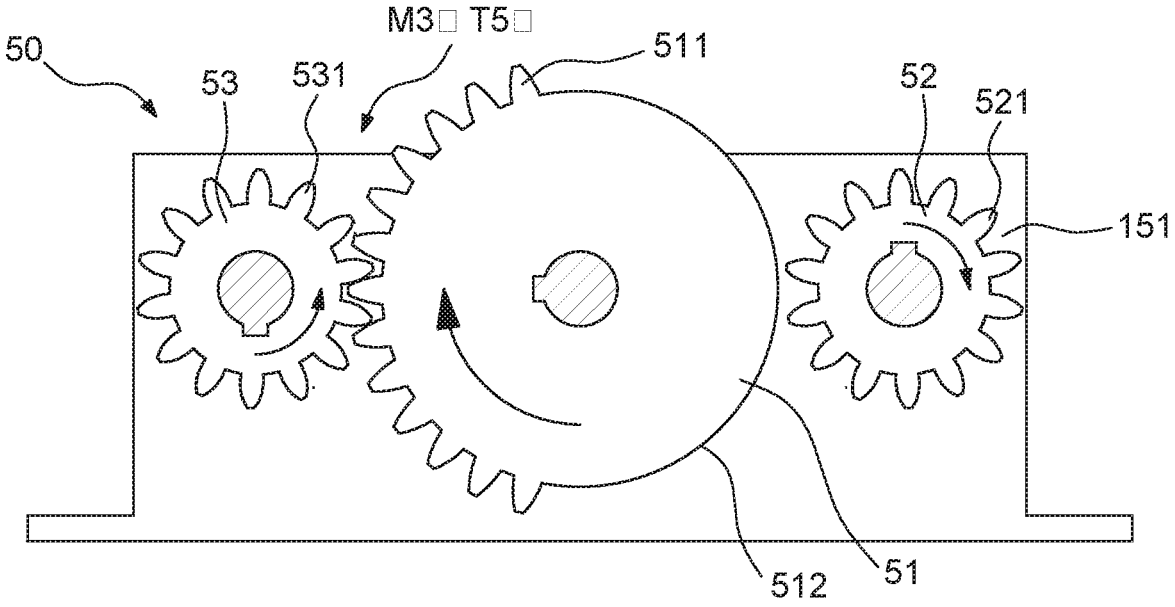
FIG. 14 is a schematic front view of a vertical coring transmission group of an automatic push corer system in a fourth state according to the present invention.

FIG. 13 is a schematic front view of a vertical coring transmission group of an automatic push corer system in a third state according to the present invention. FIG. 14 is a schematic front view of a vertical coring transmission group of an automatic push corer system in a fourth state according to the present invention. Referring to FIG. 3, FIG. 13, and FIG. 14, in an embodiment, during rotation of the third transmission member 51, when the third grinding tooth portion 511 and the fifth grinding tooth portion 531 of the fifth transmission member 53 are opposite to each other, so that the fifth grinding tooth portion 531 engages with the third grinding tooth portion 511, the third transmission member 51 may drive the fifth transmission member 53 to rotate. In this case, when the second inserted tooth portion 512 of the third transmission member 51 and the fourth grinding tooth portion 521 of the fourth transmission member 52 are opposite to each other, and the third transmission member 51 does not limit actuation of the fourth transmission member 52. In this way, the third transmission member 51 may be configured to cooperate with the fifth transmission member 53 to perform a second rotary stage T5 of the third intermittent rotary motion M3.

Referring to FIG. 3, and FIG. 11 to FIG. 14, in an embodiment, the third transmission member 51 is a gear, the gear of the third transmission member 51 may be based on an incomplete gear designed by "modulus=3" and "number of teeth=29", a complete number of the teeth of the gear is 13, the gear serves as the third grinding tooth portion 511, and the number of teeth corresponding to a periphery of the second inserted tooth portion 512 is 16 (actually not having teeth). The fourth transmission member 52 and the fifth transmission member 53 are each a gear. The gears of the fourth transmission member 52 and the fifth transmission member 53 may respectively be based on a complete gear designed by "modulus=3" and "number of teeth=14". In this way, when the second transmission member 42 drives the third transmission member 51 to rotate one cycle, 180° is the first rotary stage T4 (that is, the fourth transmission member 52 is driven to rotate one cycle), and another 180° is the second rotary stage T5 (that is, the fifth transmission member 53 is driven to rotate one cycle). Selection of gear sizes of the third transmission member 51, the fourth transmission member 52, and the fifth transmission member 53 is not limited to the foregoing, and a gear of another size may still be selected based on an actual operating requirement.

Referring to FIG. 1 to FIG. 3 again, the clamp group 60 is coupled to the fourth transmission member 52 and the fifth transmission member 53 of the vertical coring transmission group 50, and the clamp group 60 is configured to cooperate with the third intermittent rotary motion M3 of the vertical coring transmission group 50 to perform a lifting reciprocation M4. In an embodiment, the fourth transmission member 52 and the fifth transmission member 53 of the vertical coring transmission group 50 may respectively use a sixth transmission member 54 and a seventh transmission member 55 to be coupled to the clamp group 60. The sixth transmission member 54 may be connected to the fourth transmission member 52 and configured to cooperate with the fourth transmission member 52 to synchronously rotate. The seventh transmission member 55 may be connected to the fifth transmission member 53 and configured to cooperate with the fifth transmission member 53 to synchronously rotate. There is a gap between the sixth transmission member 54 and the seventh transmission member 55, and the sixth transmission member 54 and the seventh transmission member 55 may each be a gear. The gears of the sixth transmission member 54 and the seventh transmission member 55 are respectively based on a complete gear designed by "modulus=3" and "number of teeth=30", but this is not limited to the foregoing, and a gear of another size may still be selected based on an actual operating requirement.

In an embodiment, the clamp group 60 includes a rack 61 and a coring collet 62. The rack 61 extends through the through hole 114 of the base 10 to be movable, and the rack 61 may be connected to the sixth transmission member 54 and the seventh transmission member 55 of the vertical coring transmission group 50, so that the sixth transmission member 54 and the seventh transmission member 55 may engage with two sides of the rack 61 that are opposite to each other. In this way, the rack 61 may be coupled to the fourth transmission member 52 and the fifth transmission member 53 by using the sixth transmission member 54 and the seventh transmission member 55.

Figure 15:
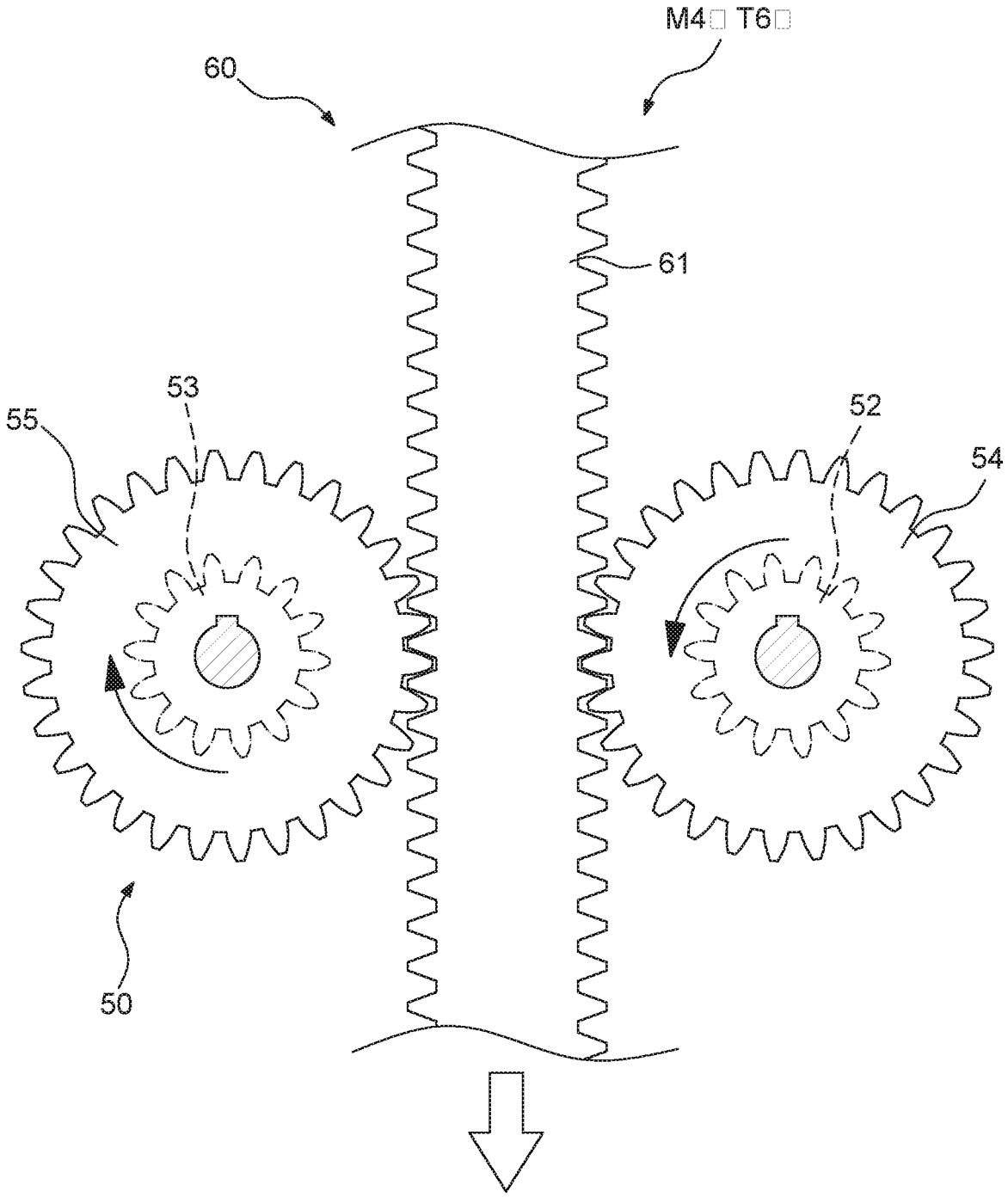
FIG. 15 is a schematic front view of a clamp group of an automatic push corer system in a descending state according to the present invention.

FIG. 15 is a schematic front view of a clamp group of an automatic push corer system in a descending state according to the present invention. Referring to FIG. 12 and FIG. 15, in an embodiment, the clamp group 60 may cooperate with the first rotary stage T4 of the vertical coring transmission group 50 to actuate. In the first rotary stage T4, the fourth transmission member 52 may rotate. In this way, the sixth transmission member 54 may be driven by the fourth transmission member 52 to rotate in a counter-clockwise direction, to drive the rack 61 of the clamp group 60 to perform a descending stage T6 of a lifting reciprocation M4. In this case, because the third transmission member 51 does not limit actuation of the fifth transmission member 53, the seventh transmission member 55 connected to the fifth transmission member 53 may cooperate with actuation of the rack 61 to rotate in a clockwise direction.

Figure 16:
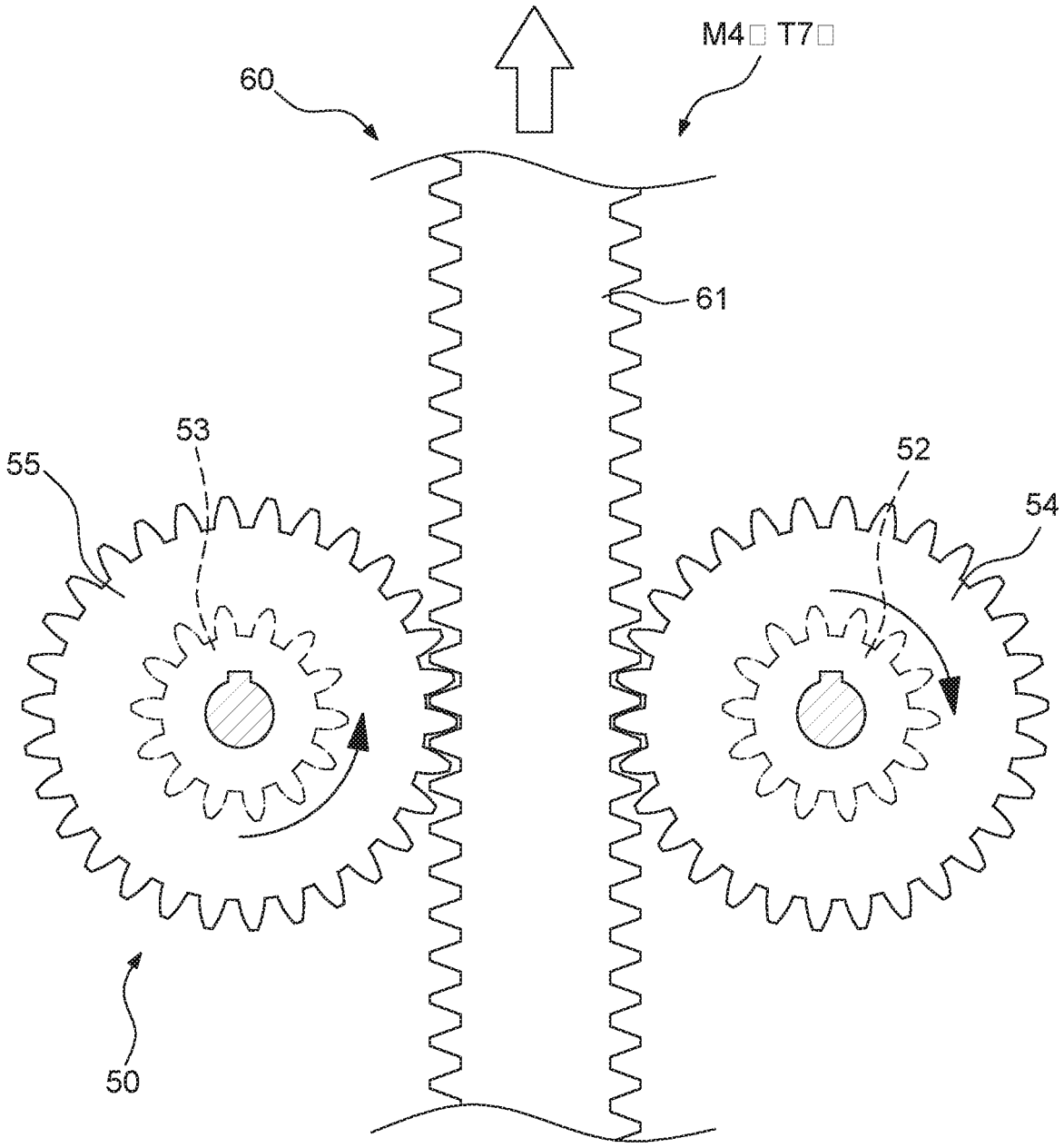
FIG. 16 is a schematic front view of a clamp group of an automatic push corer system in an ascending state according to the present invention.

FIG. 16 is a schematic front view of a clamp group of an automatic push corer system in an ascending state according to the present invention. Referring to FIG. 13, FIG. 14 and FIG. 16, in an embodiment, the clamp group 60 may cooperate with the second rotary stage T5 of the vertical coring transmission group 50 to actuate. FIG. 13 shows a stage in which the rack 61 completes the descending stage T6 and wants to convert an actuation direction. In this case, the fourth transmission member 52 and the fifth transmission member 53 are in a static state. In the second rotary stage T5, the fifth transmission member 53 may rotate. In this way, the seventh transmission member 55 may be driven by the fifth transmission member 53 to rotate in counter-clockwise direction, to drive the rack 61 of the clamp group 60 to perform an ascending stage T7 of the lifting reciprocation M4. In this case, because the third transmission member 51 does not limit actuation of the fourth transmission member 52, the sixth transmission member 54 connected to the fourth transmission member 52 may cooperate with actuation of the rack 61 to rotate in a clockwise direction.

Figure 17:
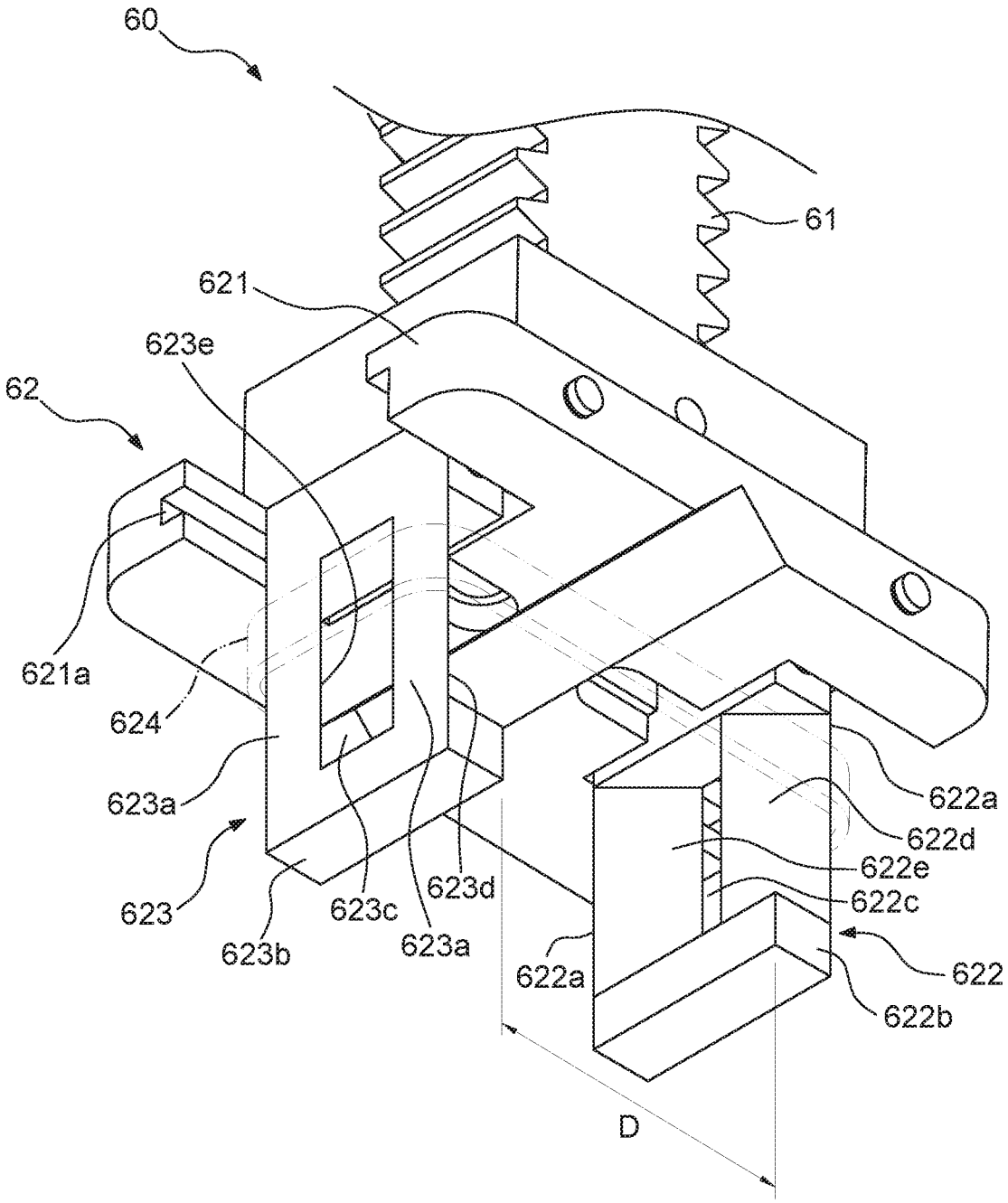
FIG. 17 is a partial schematic perspective diagram of a clamp group of an automatic push corer system according to the present invention.

FIG. 17 is a partial schematic perspective diagram of a clamp group of an automatic push corer system according to the present invention. Referring to FIG. 1 and FIG. 17, in an embodiment, the coring collet 62 is disposed at an end of the rack 61, and the coring collet 62 may be located in the accommodating space 14 of the base 10. The coring collet 62 includes a connection base 621, a first clamping jaw 622, a second clamping jaw 623, and an elastic element 624. The connection base 621 is disposed at an end of the rack 61, the first clamping jaw 622 and the second clamping jaw 623 are combined with two opposite sliding grooves 621*a* of the connection base 621 to be movable, and there is a clamping distance D between the first clamping jaw 622 and the second clamping jaw 623.

The first clamping jaw 622 includes two first vertical bar portions 622*a* and a first horizontal bar portion 622*b*. The first vertical bar portions 622*a* and the first horizontal bar portion 622*b* are connected to each other and form a first opening 622*c* together. Inner side surfaces of the first vertical bar portions 622*a* respectively form first beveled surfaces 622*d* and 622*e*, and the first beveled surfaces 622*d* and 622*e* of the first vertical bar portions 622*a* each face a same direction. In addition, the second clamping jaw 623 similarly includes two second vertical bar portions 623*a* and a second horizontal bar portion 623*b*, the second vertical bar portions 623*a* and the second horizontal bar portion 623*b* are connected to each other and form a second opening 623*c* together, inner side surfaces of the second vertical bar portions 623*a* respectively form second beveled surfaces

623*d* and 623*e*, and the second beveled surfaces 623*d* and 623*e* of the second vertical bar portions 623*a* each face a same direction.

The elastic element 624 is connected to the first clamping jaw 622 and the second clamping jaw 623. A tension spring, an elastic adhesive tape, or another element having a same elastic function may be selected for the elastic element 624. In this way, when the first clamping jaw 622 and the second clamping jaw 623 bear lateral thrust and move in the sliding grooves 621*a* of the connection base 621 to be in a ringent state, the first clamping jaw 622 and the second clamping jaw 623 may still use the elastic element 624 to go back to original positions after the lateral thrust disappears. In the embodiment shown in FIG. 17, the elastic element 624 is an elastic adhesive tape, and the an elastic adhesive tape is sleeved on peripheral surfaces of the first clamping jaw 622 and the second clamping jaw 623.

Referring to FIG. 1 to FIG. 3 again, in an embodiment, the coring group 70 is coupled to the driven member 32 of the Geneva transmission group 30, and the coring group 70 may include several coring tubes 71. The coring group 70 includes a dial 72, and a center axis 73, the dial 72 is provided with several perforation holes 721, the coring tubes 71 are respectively accommodated in the perforation holes 721 to be movable, one end of the center axis 73 is connected to the driven member 32 of the Geneva transmission group 30, and the other end of the center axis 73 is connected to the dial 72. In this way, the dial 72 may cooperate with the driven member 32 to synchronously perform the first intermittent rotary motion M1.

Various common push corers on the market may be selected for the coring tubes 71. Referring to FIG. 1 and FIG. 2, in an embodiment, two opposite ends of the coring tubes 71 are respectively provided with an actuation end 711 and a coring end 712. A T-shaped handle may be selected for the actuation end 711, the coring end 712 may abut against the baseplate 13 of the base 10, but this is not limited to the foregoing. After the coring tube 71 is clamped by using the coring collet 62, the coring tube 71 is driven by using the rack 61 to pass the punch 131 of the baseplate 13, to use the coring end 712 to core marine sediment, and seawater is drained by using an one-way water valve inside the coring tubes 71, to successfully complete an coring operation of the coring tubes 71.

In detail, the coring group 70 may cooperate with the first intermittent rotary motion M1 of the Geneva transmission group 30, and cooperate with the lifting reciprocation M4 of the clamp group 60 to actuate, to respectively complete a coring operation and a tubing replacing operation. Referring to FIG. 2, and FIG. 4 to FIG. 8, using one of the index stages T1 of the Geneva transmission group 30 as an example, because the dial 72 of the coring group 70 may synchronously rotate by using the center axis 73 and the driven member 32, in the rotation time of the driven member 32, the coring tubes 71 disposed on the dial 72 may also cooperate to rotate by a same angle as the rotation angle θ of the driven member 32. In this case a tube replacing time of the coring tubes 71 may be set to complete the tube replacing operation. In addition, in the static time of the driven member 32, the coring collet 62 of the clamp group 60 may clamp one of the coring tubes 71 on the dial 72, to cooperate the rack 61 of the clamp group 60 to perform the lifting reciprocation M4. In this case, a coring time of the coring tube 71 may be set to complete the coring operation on marine sediment.

Figure 18:
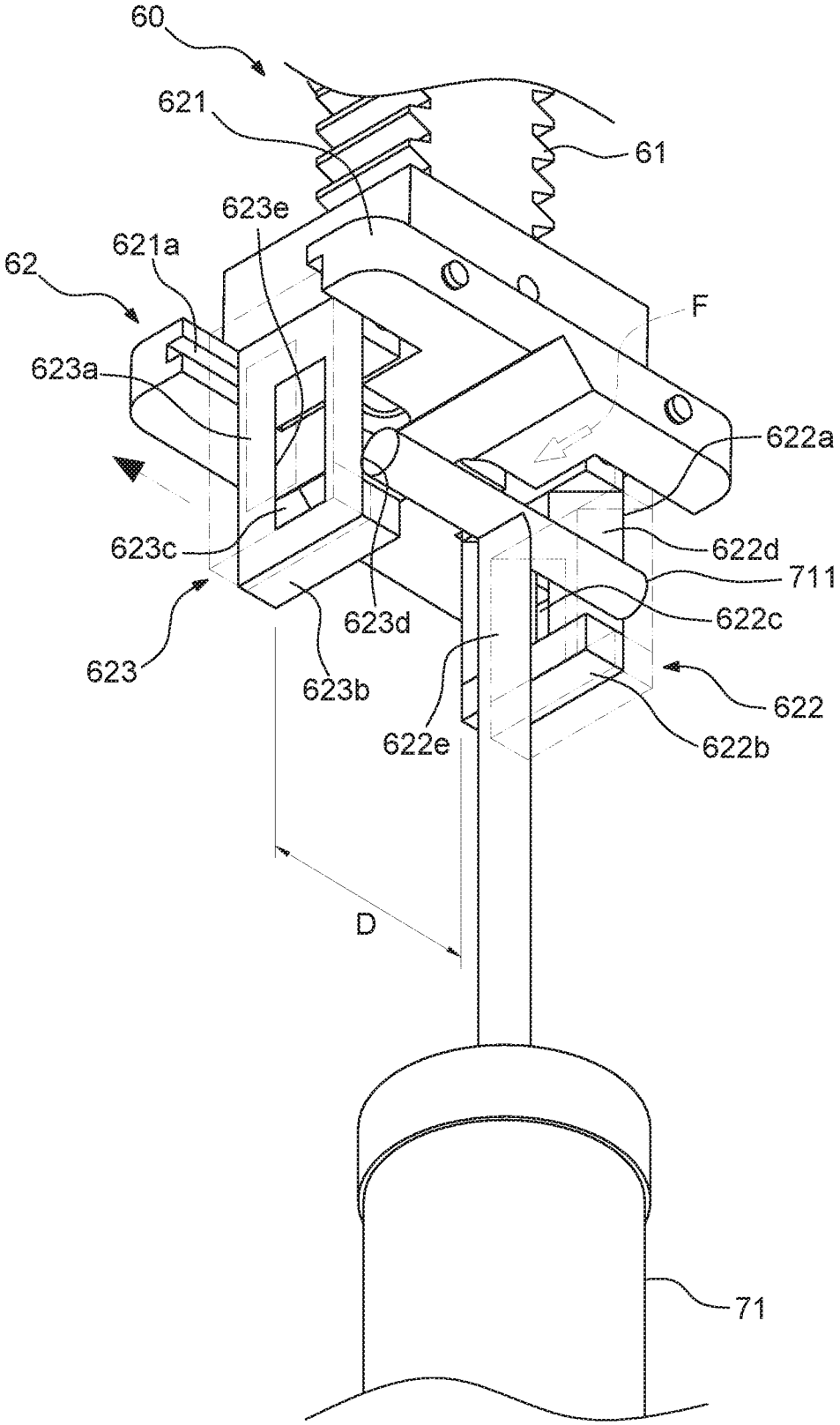
FIG. 18 is a schematic perspective diagram of a first clamp and a second clamp of an automatic push corer system that bear lateral thrust according to the present invention.

FIG. 18 is a schematic perspective diagram of a first clamp and a second clamp of an automatic push corer system that bear lateral thrust according to the present invention (no elastic element is shown). Referring to FIG. 17 and FIG. 18, in the tube replacing time of the coring tubes 71, when an actuation end 711 of one of the coring tubes 71 contacts the coring collet 62 during rotation, the actuation end 711 may generate lateral thrust F to the first clamping jaw 622 and the second clamping jaw 623, and the first beveled surface 622*d* of the first clamping jaw 622 and the second beveled surface 623*d* of the second clamping jaw 623 are designed so that the first clamping jaw 622 and the second clamping jaw 623 may be forced to be in a ringent state to two sides. In this case, the elastic element 624 in FIG. 17 may be in a tension state, the clamping distance D may also be relatively extended, so that the actuation end 711 of the coring tube 71 may successfully enter the first opening 622*c* of the first clamping jaw 622 and the second opening 623*c* of the second clamping jaw 623.

Figure 19:
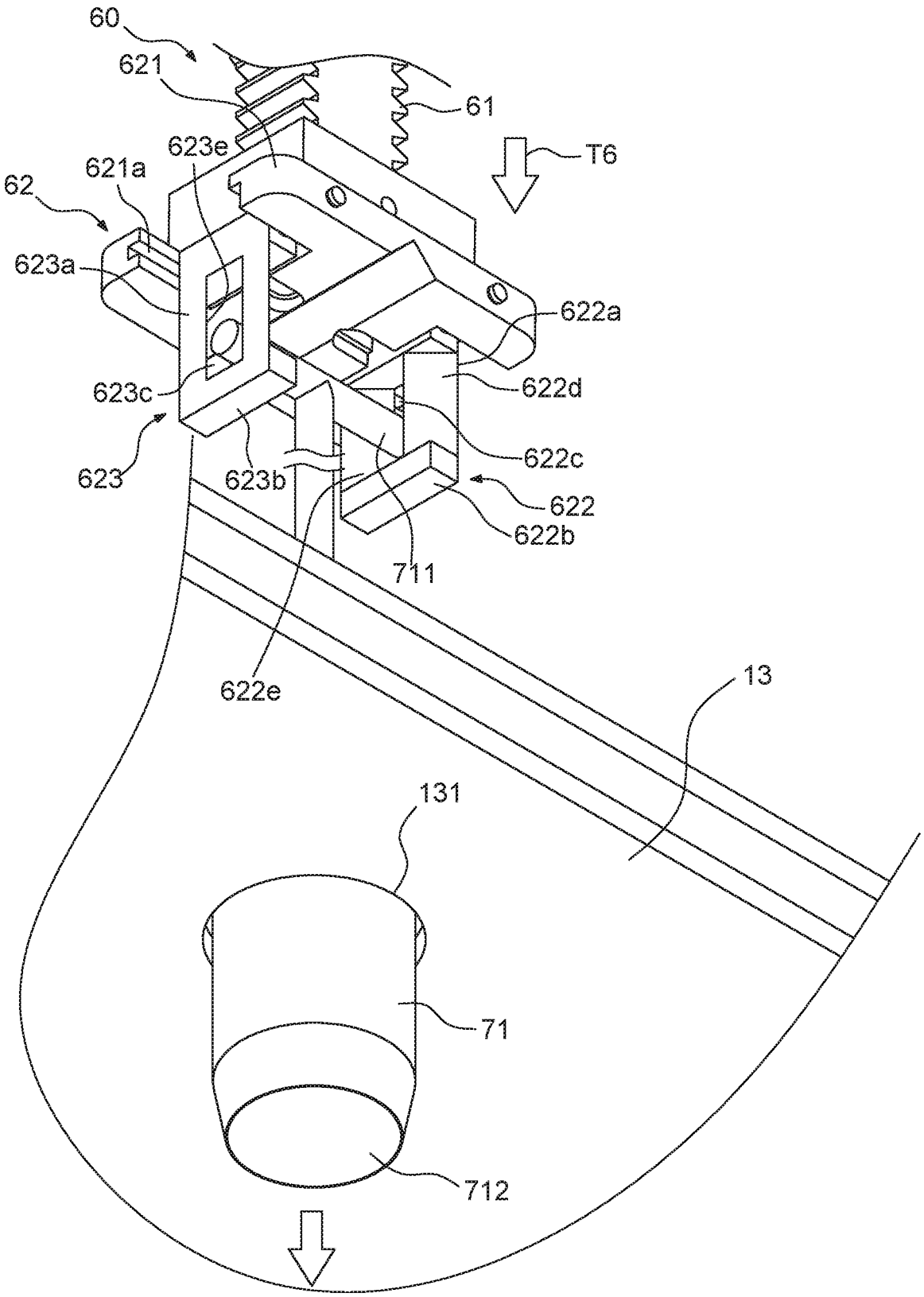
FIG. 19 is a schematic perspective diagram when a clamp group of an automatic push corer system clamps a coring tube according to the present invention.

FIG. 19 is a schematic perspective diagram when a clamp group of an automatic push corer system clamps a coring tube according to the present invention (no elastic element is shown). Referring to FIG. 15, FIG. 16 and FIG. 19, after the actuation end 711 of the coring tube 71 enters the first opening 622*c* of the first clamping jaw 622 and the second opening 623*c* of the second clamping jaw 623, that is the coring time of the coring tube 71, and the coring end 712 of the coring tube 71 may be corresponding to a position of the punch 131 of the baseplate 13. In this case, the descending stage T6 of the rack 61 drives the coring tube 71 to pass the punch 131 of the baseplate 13, to use the coring end 712 to core marine sediment. After the coring operation of the coring tubes 71 is completed, the ascending stage T7 of the rack 61 drives the coring tube 71 to pass the punch 131 of the baseplate 13 again, to go back an original position, and switch to the tube replacing time of the coring tubes 71.

Figure 20:
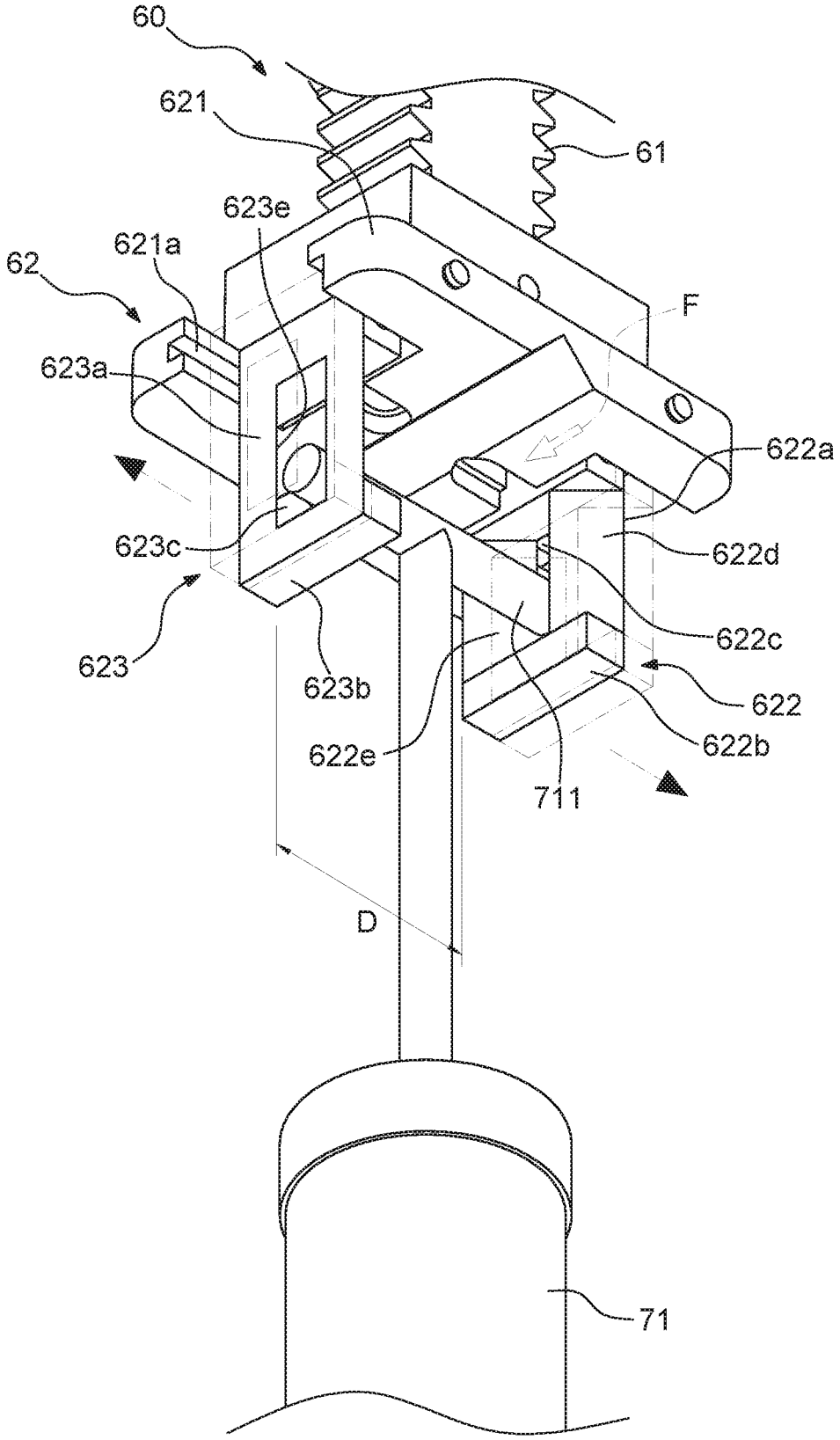
FIG. 20 is a schematic perspective diagram when a coring tube of an automatic push corer system gets away from a coring collet according to the present invention.

FIG. 20 is a schematic perspective diagram when a coring tube of an automatic push corer system gets away from a coring collet according to the present invention (no elastic element is shown). Referring to FIG. 17 and FIG. 20, during switching to the tube replacing time of the coring tubes 71, and during rotation of the coring tube 71 clamped by the coring collet 62, the actuation end 711 generates lateral thrust F to the first clamping jaw 622 and the second clamping jaw 623 again, and another first beveled surface 622*e* of the first clamping jaw 622 and another second beveled surface 623*e* of the second clamping jaw 623 are designed so that the first clamping jaw 622 and the second clamping jaw 623 may be forced again to be in a ringent state to two sides. In this case, the elastic element 624 in FIG. 17 may be in a tension state, the clamping distance D may also be relatively extended, so that the actuation end 711 of the coring tube 71 may successfully get away from the first opening 622*c* of the first clamping jaw 622 and the second opening 623*c* of the second clamping jaw 623. After the lateral thrust F disappears, an elastic resetting function of the elastic element 624 is used so that the first clamping jaw 622 and the second clamping jaw 623 may go back to an original position, and then proceed to the tube replacing operation and the coring operation of next coring tube 71.

The following describes a complete implementation procedure when the automatic push corer system 1 of the present invention is configured to perform a coring operation on marine sediment.

Referring to FIG. 1, the automatic push corer system 1 of the present invention may move and select a coring site with a small and medium-sized ROV, after the coring site is selected, the automatic push corer system 1 sinks into water, and the base 10 is ensured to be capable of being disposed on the seabed.

Referring to FIG. 3, the motor 22 of the power group 20 may continuously drives the rotating shaft 21 to rotate.

Referring to FIG. 3 and FIG. 8, the Geneva transmission group 30 is configured to perform the first intermittent rotary motion M1. The rotating shaft 21 may drive the driving member 31 of the Geneva transmission group 30 to rotate, and the driving member 31 transmits the driven member 32 to perform several index stages T1. In this way, when the rotating shaft 21 controls the driving member 31 to rotate one cycle, the driven member 32 may correspondingly complete one of the index stages T1. As shown in FIG. 6, in one of the index stages T1, the driven member 32 includes the rotation time (a rotation angle $\alpha$) and the static time (that is, a rotation angle $\beta$).

Referring to FIG. 3, FIG. 9 and FIG. 10, the intermittent transmission group 40 is configured to perform the second intermittent rotary motion M2. The rotating shaft 21 may drive the first transmission member 41 of the intermittent transmission group 40 to rotate, and the first transmission member 41 transmits the second transmission member 42 to perform the actuation stage T2 and the standstill stage T3. In this way, when the rotating shaft 21 drives the first transmission member 41 to rotate one cycle, the rotation angle $\theta 1$ of the first transmission member 41 is the actuation stage T2 of the second transmission member 42 (that is, the second transmission member 42 cooperates to rotate one cycle), the rotation angle $\theta 2$ of the first transmission member 41 is the standstill stage T3 of the second transmission member 42 (that is, the second transmission member 42 is static).

Referring to FIG. 3, FIG. 11 and FIG. 14, the vertical coring transmission group 50 is configured to perform the third intermittent rotary motion M3. When the second transmission member 42 is in the actuation stage T2, the second transmission member 42 may drive the third transmission member 51 of the vertical coring transmission group 50 to rotate, and the third transmission member 51 transmits the fourth transmission member 52 and the sixth transmission member 54 to perform the first rotary stage T4, and transmits the fifth transmission member 53 and the seventh transmission member 55 to perform the second rotary stage T5. In this way, when the third transmission member 51 rotates one cycle, 180° is the first rotary stage T4 (that is, the fourth transmission member 52 and the sixth transmission member 54 are driven to rotate one cycle), and another 180° is the second rotary stage T5 (that is, the fifth transmission member 53 and the seventh transmission member 55 are driven to rotate one cycle).

Referring to FIG. 3, FIG. 15, and FIG. 16, the clamp group 60 is configured to perform the lifting reciprocation M4. When the fourth transmission member 52 and the sixth transmission member 54 are in the first rotary stage T4, the fourth transmission member 52 and the sixth transmission member 54 may drive the rack 61 of the clamp group 60 to perform the descending stage T6; and when the fifth transmission member 53 and the seventh transmission member 55 are in the second rotary stage T5, the fifth transmission member 53 and the seventh transmission member 55 may drive the rack 61 to perform the ascending stage T7.

Referring to FIG. 1, FIG. 2, and FIG. 17 to FIG. 20, the rotation time of the driven member 32 (corresponding to the standstill stage T3 of the second transmission member 42) may be set to the tube replacing time of the coring tubes 71 of the coring group 70, and the static time of the driven member 32 (corresponding to the actuation stage T2 of the second transmission member 42) may be set to the coring time of the coring tubes 71. In the tube replacing time of the coring tubes 71, the dial 72 of the coring group 70 may drive one of the coring tubes 71 to be below the clamp group 60, and the coring collet 62 may also successfully clamp the coring tube 71. In this case, it is the coring time of the coring tubes 71; the lifting reciprocation M4 of the clamp group 60 is cooperated to use the coring tube 71 to complete a coring operation on marine sediment. After the coring operation of the coring tube 71 is completed, return to the tube replacing time of the coring tubes 71 to repeat the foregoing actions, and perform a tubing replacing operation and a coring operation of next coring tube 71.

Given the above, the automatic push corer system 1 of the present invention may use a single power source of the motor 22 of the power group 20, and cooperate with structural design of the Geneva transmission group 30, the intermittent transmission group 40, the vertical coring transmission group 50, the clamp group 60, and the coring group 70, to complete tube replacing operations and several times of coring operations of the coring tubes 71. Therefore, effects of simplifying the structure and reducing usage costs are achieved. In addition, by using automated structure design of the automatic push corer system 1 of the present invention, under a precondition of not needing to depend on a mechanical arm, positioning and coring operations on the marine sediment can further be completed with a small and medium-sized ROV to improve usage convenience.

While several embodiments of the present disclosure have been illustrated and described, various modifications and improvements can be made by those skilled in the art. The embodiments of the present disclosure are therefore described in an illustrative but not in a restrictive sense. It is intended that the present disclosure should not be limited to the particular forms as illustrated and that all modifications which maintain the spirit and scope of the present disclosure are within the scope defined in the appended claims.

What is claimed is:

1. An automatic push corer system comprising:

a base;

a power group, disposed on the base, the power group having a rotating shaft and a motor, the rotating shaft coupled to the motor;

a Geneva transmission group, disposed on the base, the Geneva transmission group having a driving member and a driven member, the driving member coupled to the rotating shaft of the power group, the driven member coupled to the driving member, the driving member configured to control the driven member to perform a first intermittent rotary motion;

an intermittent transmission group, disposed on the base, the intermittent transmission group having a first transmission member and a second transmission member, the first transmission member coupled to the rotating shaft of the power group, and the second transmission member coupled to the first transmission member, the first transmission member configured to cooperate with the second transmission member to perform a second intermittent rotary motion;

a vertical coring transmission group, disposed on the base, the vertical coring transmission group having a third transmission member, a fourth transmission member, and a fifth transmission member, the third transmission member coupled to the second transmission member of the intermittent transmission group, and the third transmission member coupled to the fourth transmission member and the fifth transmission member, the third transmission member configured to cooperate with the second intermittent rotary motion of the intermittent transmission group to control the fourth transmission member and the fifth transmission member to perform a third intermittent rotary motion;

a clamp group, coupled to the fourth transmission member and the fifth transmission member of the vertical coring transmission group, the clamp group configured to cooperate with the third intermittent rotary motion of the vertical coring transmission group to perform a lifting reciprocation; and a coring group, coupled to the driven member of the Geneva transmission group, the coring group having a plurality of coring tubes, the coring group configured to cooperate with the first intermittent rotary motion of the driven member, and cooperate with the lifting reciprocation of the clamp group, to respectively complete a coring operation and a tubing replacing operation.

2. The automatic push corer system according to claim 1, wherein the driving member of the Geneva transmission group has a first end surface and a second end surface that are opposite to each other, and the second end surface faces the base, and a locking plate and a pin member are disposed on the second end surface of the driving member, a periphery of the locking plate is provided with a convex arc portion and a concave portion, and the pin member is opposite to the concave portion of the locking plate, a periphery of the driven member is provided with a plurality of radial grooves and a plurality of concave arc portions, and the concave arc portions are in cooperation with the convex arc portion of the locking plate, there is one concave arc portion between any two of the radial grooves.

3. The automatic push corer system according to claim 2, wherein the driving member uses a first bevel gear and a second bevel gear to be connected to the rotating shaft, the first bevel gear is disposed on the rotating shaft, and the second bevel gear is disposed on the first end surface of the driving member, the first bevel gear and the second bevel gear engage with each other.

4. The automatic push corer system according to claim 1, wherein a periphery of the first transmission member comprises a first grinding tooth portion and a first inserted tooth portion, a periphery of the second transmission member comprises a second grinding tooth portion, and the second transmission member and the first transmission member are connected to each other.

5. The automatic push corer system according to claim 1, wherein a periphery of the third transmission member comprises a third grinding tooth portion and a second inserted tooth portion, a periphery of the fourth transmission member comprises a fourth grinding tooth portion, and a periphery of the fifth transmission member comprises a fifth grinding tooth portion, the fourth transmission member, the fifth transmission member and the third transmission member are connected to each other, and the third transmission member is located between the fourth transmission member and the fifth transmission member.

6. The automatic push corer system according to claim 1, wherein the fourth transmission member and the fifth transmission member of the vertical coring transmission group respectively use a sixth transmission member and a seventh transmission member to be coupled to the clamp group, the sixth transmission member is connected to the fourth transmission member, the seventh transmission member is connected to the fifth transmission member.

7. The automatic push corer system according to claim 6, wherein the base comprises a base body and a plurality of positioning frames, the positioning frames are connected to each other to form a frame body, the frame body is combined with the base body, the base body has a through hole, the base body and the positioning frames together enclose an accommodating space, the clamp group comprises a rack and a coring collet, the rack extends through the through hole of the base, and the sixth transmission member and the seventh transmission member of the vertical coring transmission group engage with two sides of the rack, the coring collet is disposed at an end of the rack, and the coring collet is located in the accommodating space of the base.

8. The automatic push corer system according to claim 7, wherein the coring collet comprises a connection base, a first clamping jaw, a second clamping jaw, and an elastic element, the connection base is disposed at an end of the rack, the first clamping jaw and the second clamping jaw are combined with the connection base to be movable, and there is a clamping distance between the first clamping jaw and the second clamping jaw, the elastic element is connected to the first clamping jaw and the second clamping jaw.

9. The automatic push corer system according to claim 8, wherein the first clamping jaw of the coring collet comprises two first vertical bar portions and a first horizontal bar portion, the first vertical bar portions and the first horizontal bar portion are connected to each other and form a first opening together, inner side surfaces of the first vertical bar portions respectively form a first beveled surface, and the first beveled surfaces of the first vertical bar portions each face a same direction.

10. The automatic push corer system according to claim 8, wherein the second clamping jaw of the coring collet comprises two second vertical bar portions and a second horizontal bar portion, the second vertical bar portions and the second horizontal bar portion are connected to each other and form a second opening together, inner side surfaces of the second vertical bar portions respectively form a second beveled surface, and the second beveled surfaces of the second vertical bar portions each face a same direction.

11. The automatic push corer system according to claim 7, wherein the base further comprises a baseplate, the baseplate is connected to the positioning frames, the baseplate comprises a punch, two opposite ends of the coring tubes comprise respectively an actuation end and a coring end, the coring end abuts against the baseplate of the base.

12. The automatic push corer system according to claim 1, wherein the coring group comprises a dial, and a center axis, the dial comprises a plurality of perforation holes, the coring tubes are respectively accommodated in the perforation holes, one end of the center axis is connected to the driven member of the Geneva transmission group, and the other end of the center axis is connected to the dial.

13. The automatic push corer system according to claim 1, wherein a fixing base is disposed on the base, the fixing base comprises a plurality of pivoting plates, the rotating shaft of the power group is rotatablely disposed on the pivoting plates, the driving member and the driven member of the Geneva transmission group are rotatablely combined with the fixing base, the first transmission member and the second transmission member are rotatablely combined with the pivoting plates, the third transmission member, the fourth transmission member and the fifth transmission member of the vertical coring transmission group are rotatablely combined with the pivoting plates.

14. The automatic push corer system according to claim 13, wherein the motor is fixed to the fixing base; the motor uses a deceleration gear group to be connected to the rotating shaft.

* * * * *